US006327562B1

(12) United States Patent
Proust

(10) Patent No.: US 6,327,562 B1
(45) Date of Patent: Dec. 4, 2001

(54) METHOD AND DEVICE FOR CODING AN AUDIO SIGNAL BY "FORWARD" AND "BACKWARD" LPC ANALYSIS

(75) Inventor: Stéphane Proust, Vieille Côte de Port l'Epine (FR)

(73) Assignee: France Telecom, Paris (FR)

( * ) Notice: Subject to any disclaimer, the term of this patent is extended or adjusted under 35 U.S.C. 154(b) by 0 days.

(21) Appl. No.: 09/202,753

(22) PCT Filed: Apr. 9, 1998

(86) PCT No.: PCT/FR98/00723

§ 371 Date: May 24, 1999

§ 102(e) Date: May 24, 1999

(87) PCT Pub. No.: WO98/47134

PCT Pub. Date: Oct. 22, 1998

(30) Foreign Application Priority Data

Apr. 16, 1997 (FR) ..... 97 04684

(51) Int. Cl.[7] ..... G10L 19/04

(52) U.S. Cl. ..... 704/219; 704/201; 704/220

(58) Field of Search ..... 704/219, 220, 704/221, 201

(56) References Cited

U.S. PATENT DOCUMENTS

| | | | | |
|---|---|---|---|---|
| Re. 36,721 | * | 5/2000 | Akamine et al. | 704/220 |
| 5,579,435 | | 11/1996 | Jansson | 395/2.42 |
| 5,651,091 | * | 7/1997 | Chen | 704/223 |
| 5,717,823 | * | 2/1998 | Kleijn | 704/220 |
| 5,745,871 | * | 4/1998 | Chen | 704/207 |
| 5,751,903 | * | 5/1998 | Swaminathan et al. | 704/230 |
| 5,774,837 | * | 6/1998 | Yeldener et al. | 704/208 |
| 5,812,954 | * | 9/1998 | Massaloux | 704/205 |
| 5,890,108 | * | 3/1999 | Yeldener | 704/208 |
| 5,903,866 | * | 5/1999 | Shoham | 704/265 |
| 5,995,923 | * | 11/1999 | Mermelstein et al. | 704/19 |
| 6,006,175 | * | 12/1999 | Holzrichter | 704/208 |
| 6,070,140 | * | 5/2000 | Tran | 704/275 |
| 6,151,634 | * | 11/2000 | Glaser et al. | 704/236 |
| 6,161,089 | * | 12/2000 | Hardwick | 704/230 |

OTHER PUBLICATIONS

Erkelens et al, "On the Statistical Properties of Line Spectrum Pairs", pp. 768–771, IEEE, 1995.*

Basson et al, "Adaptive Estimation of Speech Parameters", pp. 177–182, COMSIG 1994.*

Ng et al, "Unstable Covariance LPC Solutions from Non-stationary Speech Waveforms", pp. 651–654, ICASSP, 1989.*

Nandkumar et al, "Robust Speech Mode Based LSFT Vector Quantization for Low Bit Rate Coders", pp. 41–44,IEEE 1998.*

Deller et al, "Discrete–Time Processing of Speech Signals", pp. 473–483, 1993.*

French Preliminary Search Report dated Dec. 18, 1997, French Appl. No. FR 9704684.

(List continued on next page.)

*Primary Examiner*—Fan Tsang
*Assistant Examiner*—Michael N. Opsasnick
(74) *Attorney, Agent, or Firm*—Marshall, Gerstein & Borun

(57) ABSTRACT

A method and device for encoding a digital audio-signal divided into a succession of blocks according to a LPC "forward" and "backward" analysis respectively under a choice criterion. For coding each current block, the choice criterion is established by defining the degree of stationarity of the digital audio-signal according to a stationarity parameter belonging to a maximum and a minimum stationarity range value. An analysis choice value is established from a decision function and this stationarity parameter and thus applied to the digital audio-signal to have this audio digital signal encoded by "backward" LPC filtering for stationary zones. The "forward" and "backward" filtering mode are thus performed in relation to the degree of stationarity of the audio digital signal, the amount of switching from one to the other filtering modes being thus limited.

14 Claims, 6 Drawing Sheets

OTHER PUBLICATIONS

International Search Report dated Jul. 1, 1998; International Appl. No. PCT/FR98/00723.

Proust et al., "Dual Rate Low Delay CELP Coding (8kbits/s 16kbits/s) using a Mixed Backward/Forward Adaptive LPC Prediction", *Proc. of the IEEE Workshop on Speech Coding For Telecommunications,* pp. 37–38 (Sep. 1995).

Maitra et al., "Speech Coding Using Forward and Backward Prediction," *IEEE,* pp. 213–215 (1986).

Zhang et al., "Real–Time Implementation of a Low Delay Low Bit Rate Vocoder with a Single ADSP–21020," *IEEE,* pp. 738–742 (1995).

* cited by examiner

LPC CURRENT BLOCK INDEX n
STAT (0)
110
111
STAT*(n)=f[(d_{n-1}(n-1),...,d_{n-p}(n-p)),STAT(n-1)]
11
STAT (n) =g (STAT*(n),Gpf,Gpb)
112

BLOCK n
d_LPC
120
121
BLOCK ENERGY < ENER_SIL?
OR STAT(n) < S_FWD
122
d_n(n)="fwd"
d_{n-1}(n-1)="bwd"
123
d_LPC > S_LSP_H(n)?
124
125
d_LPC < S_LSP_L(n)?
126b
Gpb > Gpf - S_STAT?
126a
Gpf > Gpb - S_TRANS?
127
Gpb > Gpf - S_PRED(n)?
Gpi > Gpf - S_PRED(n)?
Gpb > G1 ET Gpi > G1 ?
128
d_n(n)="fwd"
129
d_n(n)="bwd"
128
d_n(n)="fwd"
129
d_n(n)="bwd"
128
d_n(n)="fwd"
d_n(n)

STAT(n_1)
1110
1111a
BLOCK ENERGY
LPC > ENER_SIL
STAT(n)=STAT(n_1)
1111b
111
DECISION $d_{n-1}(n-1)$="fwd"?
1111
1113
N_BWD=N_BWD+1
1112
$d_{n-2}(n-2)$="bwd"?
1114
N_BWD > Na ?
STAT*(n)=STAT(n_1)
1118
N_BWD < Nb ?
STAT*(n)=STAT(n-1)
1114a
1118b
STAT*(n)=STAT(n_1)
1114b
1118a
STAT*(n)=STAT(n-1)+fa(N_BWD)
STAT(n)
STAT*(n)=STAT(n-1)-fb(N_BWD)
STAT(n)
1118c
N_BWD=0
STAT*(n)
DGfb(Gpf,Gpb)
1120
ΔS=fr(Gpf, Gpb)
STAT(n)=STAT*(n)+ΔS
1121
112
STAT(n)
1122

METHOD AND DEVICE FOR CODING AN AUDIO SIGNAL BY "FORWARD" AND "BACKWARD" LPC ANALYSIS

FIELD OF THE INVENTION

The invention involves a procedure and a device for coding an audio-frequency signal, such as a speech signal, by means of "forward" and "backward" LPC analysis.

At present, the aim of coding techniques for audio-frequency signals, particularly speech signals, is to allow for the transmission of these signals in digital form, within the conditions of reduction of the transmission output, in order, particularly, to ensure a management adapted to the networks for transmitting these signals, taking into consideration the considerable growth in transactions between users.

BACKGROUND OF THE INVENTION

Of the coding techniques used, that designated by LPC analysis, Linear Predictive Coding in English, consists of carrying out a linear prediction of the audio-frequency signal to be encoded, the coding being carried out temporarily by means of a linear filtering prediction applied to the successive blocks of this signal.

Of the aforementioned techniques, that known as CELP coding, Code Excited Linear Prediction, is the most widespread and provides some of the best performance. Other techniques, such as the technique designated by MP-LPC, Multi Pulse Linear Predictive Coding, or the VSELP technique, Vector Sum Excited Linear Prediction in English, are relatively similar to CELP coding.

The aforementioned coding techniques are known as "analysis by synthesis". They have enabled in particular, for audio-frequency signals belonging to the telephonic frequency bandwidth, the transmission output of these signals to be reduced from 64 kb/s (MIC coding) to 16 kb/s with the help of the CELP coding technique and even to 8 kb/s where these encoders use the most recent developments of this coding technique, without any perceptible reduction in the quality of the voice reconstituted after transmission and decoding.

A particularly important area of application for these coding techniques is, in particular, that of mobile telephony. Within this area of application, the necessary limitation of the frequency bandwidth granted to each mobile-telephony operator and the extremely rapid increase in the number of subscribers makes necessary the corresponding reduction of the coding output, while user demands in terms of speech quality continue to grow. Other areas of application of these coding techniques concern, for example, the storage of digital data which represent these signals on memory supports, high-quality telephony for video or audio conference applications, multimedia or digital transmissions via satellite.

The linear prediction filters used in the aforementioned techniques are obtained with the help of an analysis module called "LPC analysis" operating on successive digital signal blocks. These filters are capable, according to the order of analysis, that is, according to the number of filter coefficients, of modeling more or less reliably the contours of the spectrum of frequencies of the signal to be coded. In the case of a speech signal, these contours are called formants.

However, for good quality coding, required by most current applications, the filter thus defined is not sufficient for perfectly modeling the signal. It is therefore essential to code the residue of the linear prediction. One such operating mode relating to linear prediction residue is particularly used by the coding technique, LD-CELP, Low Delay CELP in English, previously mentioned in the description. In this case, the residual signal is modeled by a waveform taken from a stochastic codepage and multiplied by a gain value. The MP-LPC coding technique, for example, models this residue with the help of variable position pulses modified by respective gain values, whereas the VSELP coding technique carries out this modeling by means of a linear combination of pulse vectors taken from appropriate lists.

An explanatory recap of the operating method of LPC analysis and especially "backward" LPC analysis and "forward" LPC analysis will be given below.

The general envelope of the frequency spectrum is modeled by means of a short-term synthesis filter, constituting the LPC filter, the coefficients of which are modeled by means of a linear prediction of the speech signal to be coded. This LPC filter, an autoregressive filter, has a transfer function of the form, equation (1):

$$A(z) = 1 - \sum_{i=1}^{p} a_i z^{-i}$$

where p designates the name of coefficients, ai of the filter and the order of the linear prediction applied, z designating the transformed variable z of the space of the frequencies.

One method of evaluating the coefficients $a_i$ consists of applying a criterion of minimization of the energy of the error prediction signal of the speech signal over the analysis length of this latter.

The analysis length for a digital speech signal formed of successive samples is, in practical terms, a number N of these samples, constituting a coding frame. The energy of the error prediction signal thus confirms equation (2):

$$Ep = \sum_{n=1}^{N} \left( s(n) - \sum_{i=1}^{p} a_i \cdot s(n-1) \right)^2$$

where s(n) designates the sample of row n in the frame of N samples.

In a block-by-block coding process, the coding frame can be advantageously divided into several subframes or adjacent LPC blocks. The analysis length N then exceeds the length of each block in order to make it possible to take into account a certain number of past or, if applicable, future samples, by means of and at the cost of delaying the appropriate coding.

The analysis is called "forward" LPC when the LPC analysis process is carried out on the block of the current frame of the speech signal to be coded, with the coding taking place at encoder level "in real time", that is, during the block of the current frame, with the only processing delay introduced by the calculation of the filter coefficients. This analysis involves transmitting the calculated values of the filter coefficients to the decoder.

"Backward" LPC analysis, used in the LD-CELP encoder at 16 kb/s is the object of the standard UIT-T G728. This analysis technique consists of carrying out the LPC analysis not on the block of the current frame of the speech signal to be coded, but on the synthesis signal. It is understood that this LPC analysis is actually performed on the synthesis signal of the block preceding the current block, as this signal is available simultaneously at encoder and decoder level.

This simultaneous operation in the encoder and decoder thus makes it possible to avoid transmitting from the encoder to the decoder the value obtained in the encoder of the LPC filter coefficients. For this reason, "backward" LPC analysis makes it possible to free up transmission output and the output thus freed can be used, for example to enrich the excitation codepages in the case of CELP coding. "Backward" LPC analysis furthermore allows an increase in the order of analysis; the number of LPC filter coefficients may be as much as 50 in the case of an LD-CELP encoder, compared to 10 coefficients for most encoders using "forward" LPC analysis.

Thus, correct operation of "backward" LPC analysis requires the following conditions:

- good quality synthesis signal, very close to the speech signal to be coded, which involves a sufficiently high coding output, higher than 13 kb/s, taking into account the quality of current CELP encoders;
- reduced frame and block length due to the delay of one block between the analyzed signal and the signal to be coded. The length of the frame and block should therefore be low in comparison to the mean stationary time of the speech signal to be coded;
- reliability of the transmission and conservation of the integrity of the data transmitted between the encoder and the decoder, by introducing few transmission errors. As soon as the synthesis signals differ significantly from the speech signal to be coded, the encoder and decoder cease to calculate the same filter and large divergences may occur, without being able to return to a noticeable similarity of the filters calculated in the encoder or decoder.

Due to the respective advantages and disadvantages of the aforementioned "backward" and "forward" types of LPC analysis, one technique consisting of selectively associating "backward" and "forward" LPC analysis was proposed in the article titled "Dual Rate Low Delay CELP Coding (8 kbits/s/16 kbits/s) using a Mixed Backward/Forward Adaptive LPC Prediction", published by S. PROUST, C. LAMBLIN and D. MASSALOUX, Proc. IEEE Workshop Speech Co. Telecomm., September. 1995, pp 37–38.

The conditions mentioned above, regarding the correct functioning of "backward" LPC analysis, show that this type of analysis alone presents the limitations mentioned when operating at transmission outputs appreciably below 16 kb/s. Besides the reduction in the quality of the synthesis signal, which reduces the performance of the LPC filter, it is very often necessary, in order to reduce the transmission output, to operate with a greater LPC frame length, of the order of 10 to 30 ms. It can therefore be seen that, under these conditions, the degradation occurs especially during transitions of the frequency spectrum and, more generally, in the not so stationary areas, since for generally very stationary signals, such as music signals, "backward" LPC analysis holds a considerable advantage over "forward" LPC analysis.

The association of the two aforementioned types of LPC analysis aims to reduce these disadvantages and increase the advantages inherent in each one:

- "forward" LPC analysis for the coding of the transitions and the non-stationary areas;
- "backward" LPC analysis, to a greater extent, for the coding of the stationary areas.

Furthermore, the introduction of LPC frames coded by "forward" LPC analysis into LPC frames coded by "backward" analysis allows the encoder and decoder to re-converge towards the same synthesis signal in the case of a transmission error and therefore offers far greater error protection than coding by "backward" LPC analysis alone.

In general, the above-mentioned mixed "forward"-"backward" LPC analysis consists of carrying out two LPC analyses, a "forward" LPC analysis of the speech signal or audio frequency to be coded and a "backward" LPC analysis of the synthesis signal.

Two filters are calculated for each LPC block, these filters being designated by "forward" LPC filter and "backward" LPC filter, respectively. A procedure of choosing the filter applied to the LPC block, depending on whether the signal is stationary, is therefore applied. This procedure requires two different criteria:

- a first criterion based on the prediction gains of the filters;
- a second criterion based on a distance parameter between the "forward" LPC filters calculated successively.

For each of these two criteria, the threshold values are established.

First Criterion:

The choice of "backward" LPC filter is made if the distance between the prediction gain of the "backward" and "forward" LPC filters is greater than a first threshold value.

Second Criterion:

For a current analysis in "backward" LPC analysis mode, prohibition of switching from "backward" LPC analysis mode to "forward" LPC analysis mode if the distance calculated on the vectors of the parameters representing two consecutive "forward" LPC filters is lower than a second threshold value, a distance which is too small characterizing a more or less stationary area, for which reason it is appropriate to avoid changing the LPC analysis mode. The calculated distance is a Euclidean distance between the spectral lines of the speech or audio-frequency signal to be coded.

A more detailed description of the aforementioned mixed LPC analysis method can be found in the article published by S. PROUST, C. LAMBLIN and D. MASSALOUX, mentioned above.

In-depth studies on the above-mentioned mixed analysis operating method have shown the following important disadvantages:

- for certain signals, the prediction gain values of the "forward" and "backward" LPC filters may oscillate above and below the first threshold value. This phenomenon leads to sudden and frequent changes from "backward" LPC filter to "forward" LPC filter or vice versa. The discontinuity of filtering thus introduced constitutes a source of considerable degradation of the synthesis signal and is not, most of the time, linked to the real spectral modifications of the speech or audio-frequency signal to be coded;
- the optimal value of the first threshold which should be established varies considerably according to whether the signal to be coded is stationary, more so when the coding output is low. For a coding delay corresponding to an LPC frame of 10 to 30 ms, or when the transmission output falls, there is a clear divergence between the coding mode of musical signals and speech signals; "forward" LPC analysis is mainly used.

Since music signals are quite stationary, "backward" LPC analysis is used even for long LPC frames. In the case of speech signals, however, the highly stationary areas have a very short duration and their passage in "backward" LPC analysis mode is therefore brief, thus leading to unwanted filter transitions which reduce the quality of the coding. The encoder can thus no longer correct the phenomena generated by the discontinuity introduced by the switching of the filters.

The LPC filter which gives the best subjective quality and which therefore best models the spectrum of the signal to be coded is not always that which has the best prediction gain. Certain switchings from one mode of LPC analysis to another, linked to an instantaneous decision, are therefore useless.

SUMMARY OF THE INVENTION

The object of the present invention is to resolve the aforementioned disadvantages by employing a procedure and device for coding a digital audio-frequency signal by means of specific "forward" and "backward" LPC analysis.

Another object of the present invention is also to employ a process for dynamically adapting the function of choice between "forward" LPC analysis and "backward" LPC analysis according to how stationary the signal to be coded is.

A further object of the present invention is also to employ a process for dynamically adapting the aforementioned choice function on the basis of discrimination between highly stationary signals, such as music or background noise, and other signals, such as speech, in order to allow the most appropriate code processing by "backward" LPC analysis and "forward" LPC analysis, respectively.

A further object of the present invention is, once the aforementioned most appropriate choice of coding has been made, for a signal to be coded of a given type or with given characteristics, to prevent any sudden switching to the LPC analysis mode not chosen and, therefore, to prevent the appearance of transitions from "forward" LPC filters to "backward" LPC filters and vice versa, which tend to reduce the quality of the reproduced synthesis signal.

A further object of the present invention is to employ a dynamic adaptation process of the aforementioned choice function by which the change in the LPC analysis mode corresponds reliably to a change in the stationarity of the signal to be coded, thus having a far lower chance of being linked to a simple crossover effect of the first and second threshold values.

The method and device for coding a digital audio-frequency signal, which are the object of the present invention, employ a double analysis based on the criterion of choice between "forward" and "backward" LPC analysis, respectively, to create a transmitted coded signal consisting of LPC filtering parameters accompanied by analysis decision information and a non-transmitted coding residue signal. The digital audio-frequency signal is subdivided into frames, succession of blocks of a determined number of samples, and the coding of this digital audio-frequency signal is carried out on this signal using a "forward" LPC filter for the non-stationary areas and a synthesis signal, respectively. This synthesis signal is obtained from the coding residue signal, using "backward" LPC filtering for the stationary areas.

They are notable insofar as they consist of and allow for, respectively:

determining the degree of stationarity of the digital audio-frequency signal according to a stationarity parameter whose value is between a maximum stationarity value and a minimum stationarity value;

establishing, based on the stationarity parameter, an analysis choice value, based on a decision function;

applying the analysis choice value to the LPC filtering in order to code the digital audio-frequency signal by means of "forward" LPC filtering on the non-stationary areas of the digital audio-frequency and by means of "backward" LPC filtering on the stationary areas of the synthesis signal.

This operating method makes it possible to prioritize remaining in either the "forward" or "backward" LPC filtering mode, according to the degree of stationarity of the digital audio-frequency signal and to limit the number of switchings from one mode of filtering to another and vice versa.

The method and the device which are the object of the present invention have an application not only in the area of mobile telephony, but also in the sector of creation and reproduction of phonograms, satellite transmission and high-quality telephony for multimedia video or audio conference applications.

BRIEF DESCRIPTION OF THE DRAWINGS

Understanding will be facilitated by reading the description and examining the design below, where.

DETAILED DESCRIPTION OF THE PREFERRED EMBODIMENTS

Figure 1:
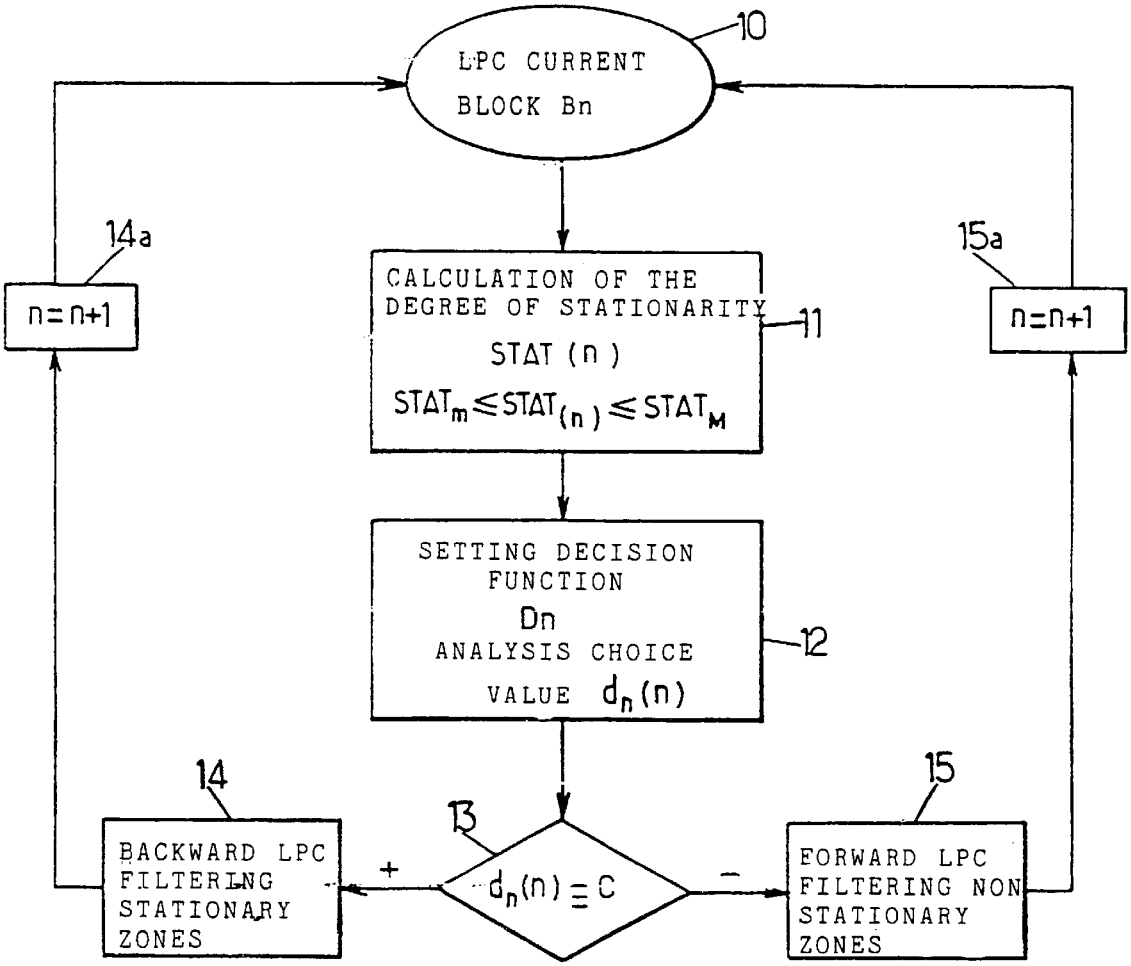
FIG. 1 shows, in the form of a general flow chart, an explanatory diagram of the stages which allow the performance of the coding which is the object of the present invention.

A more detailed description of the method for coding a digital audio-frequency signal, employing a double analysis based on the criterion of choice between "forward" and "backward" LPC analysis, respectively, of a transmitted coded signal, which is the object of the present invention, is now given in connection with FIG. 1.

In general terms, it is shown that the transmitted coded signal, written as $s_c_n(t)$, consists in part of the LPC filtering parameters accompanied by LPC analysis decision information. Furthermore, a non-transmitted coding residue signal, $res_n(t)$, is available for performing the coding procedure.

The digital audio-frequency signal is subdivided into LPC frames, a succession of LPC blocks, each block, for the sake of convenience of the description, being written as Bn and having a determined number of samples, N.

One aspect of the coding procedure which is the object of the present invention consists of carrying out the aforementioned coding of the digital audio-frequency signal as described above using "forward" LPC filtering for the non-stationary areas and for a synthesis signal obtained from the coding residue signal using "backward" LPC filtering for the stationary areas.

A particularly notable aspect of the method which is the object of the present invention consists of, in order to establish the "forward" or "backward" LPC filter choice criteria for each current block of the succession of current blocks forming the current frame, as shown in FIG. 1, each current block, written $B_n$, being available in an initial stage 10, to determine in stage 11 the degree of stationarity of the digital audio-frequency signal, according to a stationarity parameter, written STAT(n). This stationarity parameter presents a digital value between a maximum stationarity value, written $STAT_M$, and a minimum stationarity value, written $STAT_m$.

By way of convention and without prejudice to the degree of generality of the coding procedure which is the object of the present invention, the stationarity parameter presents the maximum value $STAT_M$ for an extremely stationary signal, whereas this stationarity parameter presents the minimum value $STAT_m$ for a highly non-stationary signal.

After the aforementioned stage 11, the coding method which is the object of the present invention consist of establishing, in stage 12, using the stationarity parameter STAT(n), an LPC analysis choice value. This analysis choice value corresponds, logically, to either the "forward" LPC analysis choice or the "backward" LPC analysis choice. The value of the choice of analysis is written $d_n(n)$ and is obtained from a specific decision function, written $D_n$.

The aforementioned stage 12 is then followed by a test stage 13 which allows the application of the analysis choice value $d_n(n)$, represented by C, to the LPC filtering in order to carry out the coding of the digital audio-frequency signal by means of "forward" LPC filtering for the non-stationary areas of the digital audio-frequency signal and by means of "backward" LPC filtering for the stationary areas of the synthesis signal.

The execution of the decision function $D_n$ and the aforementioned analysis choice values $d_n(n)$ form a particularly advantageous aspect of the coding procedure which is the object of the present invention, as they make it possible to prioritize remaining in one of the LPC filtering modes, either "forward" or "backward", according to the degree of stationarity of the audio-frequency signal and to limit the number of switchings from one to other of the filtering modes, and vice versa.

In general terms, it is mentioned that the decision function executed in stage 12 and indicated as $D_n$ is an adaptive function, updated for each current block $B_n$ from the stationarity parameter.

Updating the adaptive function makes it possible to prioritize remaining in one of the LPC filtering modes, either "forward" or "backward", according to the degree of stationarity of the digital audio-frequency signal and to hence limit the number of switchings from one to other of the filtering modes, and vice versa.

More specifically, the analysis choice value $d_n(n)$ established according to the aforementioned decision function $D_n$ corresponds to a priority value of the LPC filtering mode, either "forward" or "backward", and to another priority value representing in fact a value of absence of priority for returning to the "backward" or "forward" LPC filtering mode.

As a priority value for the LPC filtering mode, it is mentioned that the analysis choice value $d_n(n)$ can, for example, correspond to a logical value, the true value of this logical value, value 1, for example, corresponding to a choice of "backward" LPC filtering, whereas the complementary value of this true value, the value zero, corresponds to a choice of "forward" LPC filtering. It can thus be seen that the test function in stage 13 can be summarized as a test value of the logical value of the aforementioned analysis choice value, to ensure in stage 14 "backward" LPC filtering for the stationary areas of the signal to be coded or "forward" LPC filtering in stage 15 for the non-stationary areas, the aforementioned stages 14 and 15 being thus followed by stages 14*a* and 15*a* back to the next block, written as $B_{n+1}$ for n=n+1.

Although the analysis choice value $d_n(n)$ is represented by a logical value, it is understood that this logical value may be associated with a value of priority and probability of the mode of filtering specifically established by the decision function $D_n$. It can particularly be seen that this probability value may correspond, for each current block $B_n$, to the true logical value for a range of probability values between zero and 1 for "backward" LPC filtering while the complementary value, the logical value zero, for example, may correspond to the complement of the aforementioned range of probability values between zero and 1 for the first aforementioned range. This probability depends on a number of successive filtering decisions within the same filtering mode.

The operating mode of the decision function $D_n$ makes it possible in fact to associate with the logical variable $d_n(n)$ the filtering mode priority and is adaptive over time for each current block $B_n$.

In general terms, it is mentioned that the aim of adapting the decision function $D_n$ is to progressively prioritize the "backward" LPC filtering mode or, in contrast, the "forward" LPC filtering mode, whichever works better, taking into account the overall stationarity of the signal to be coded, in order to avoid as far as possible any unnecessary switching from one mode of filtering to another.

More specifically:

the more stationary the signal to be coded, the more the decision function $D_n$ prioritizes "backward" LPC analysis, limiting as far as possible switching to "forward" LPC filtering mode;

in contrast, the less stationary the signal to be coded, the more the decision function $D_n$ prioritizes "forward" LPC analysis, limiting as far as possible any switching to "backward" LPC filtering mode.

A more detailed description of the execution of the specific decision function which makes it possible to adapt this decision function, according to the value of the stationarity parameter STAT(n), is given later in the description.

A method of preferential calculation of the stationarity parameter STAT(n) relating to each current LPC block $B_n$ is now given and described in connection with FIG. 2*a*.

Figure 2A:
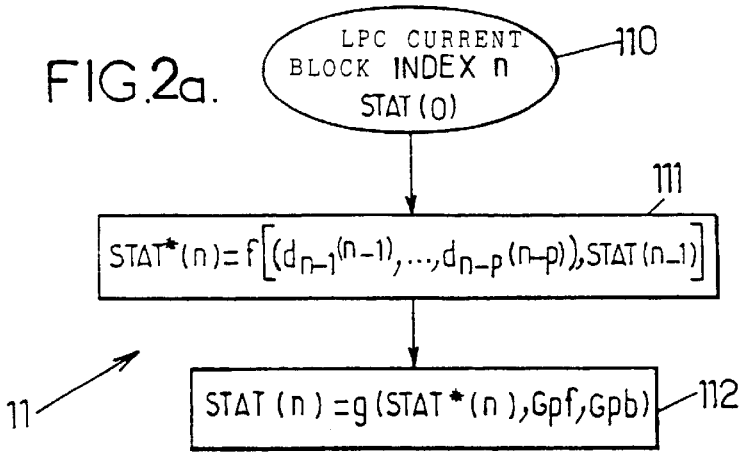
FIG. 2*a* shows a general flow chart of the stages of calculating the stationarity parameter for each current LPC block.

According to the aforementioned figure, stage 11, consisting of determining the degree of stationarity of each current block $B_n$ of the digital audio-frequency signal consists, starting with an arbitrary initial value of the stationarity parameter, as shown in stage 110 FIG. 2*a*, this arbitrary value being written STAT(O), of calculating in stage 111 for this current block $B_n$, an intermediate stationarity parameter value, written STAT*(n), as a function of a determined number of successive analysis choice values, these LPC analysis choice values, written $d_{n-1}(n-1), \ldots,$ to $d_{n-p}(n-p)$, being obtained for different successive blocks prior to the current block $B_n$ of the succession of LPC blocks and a value of the stationarity parameter of the block preceding the current block, this stationarity value being written STAT(n−1). In stage 111 shown in FIG. 2*a*, the function of the determined number of previous analysis choice values is given in relation to these previous values, written $d_{n-1}(n-1)$ to $d_{n-p}(n-p)$. The initial arbitrary value for the stationarity parameter STAT(O) can, for example, be the same as the mean value between the maximum value and the minimum value of the stationarity parameter mentioned above in the description, $STAT_M$ and $STAT_m$.

The aforementioned stage 111 is then followed by stage 112 which consists of tuning the intermediate stationarity parameter value according to the value of the prediction gains of the "forward" and "backward" LPC filters or analysis mode of the frame preceding the current frame. In stage 112 of FIG. 2*a*, the aforementioned function is written g(STAT*(n), Gpf, Gpb) where Gpf is the prediction gain of the "forward" LPC filter and Gpb is the prediction gain of the "backward" LPC filter for the frame preceding the current frame. In stage 112, that is, the stage which consists of tuning the intermediate stationarity parameter value, the stationarity parameter value STAT(n) of the current LPC block $B_n$ is given the value, equation (3):

$$STAT(n)=g(STAT^*(n), Gpf, Gpb)$$

corresponding to the tuned intermediate stationarity parameter value.

Figure 2F:
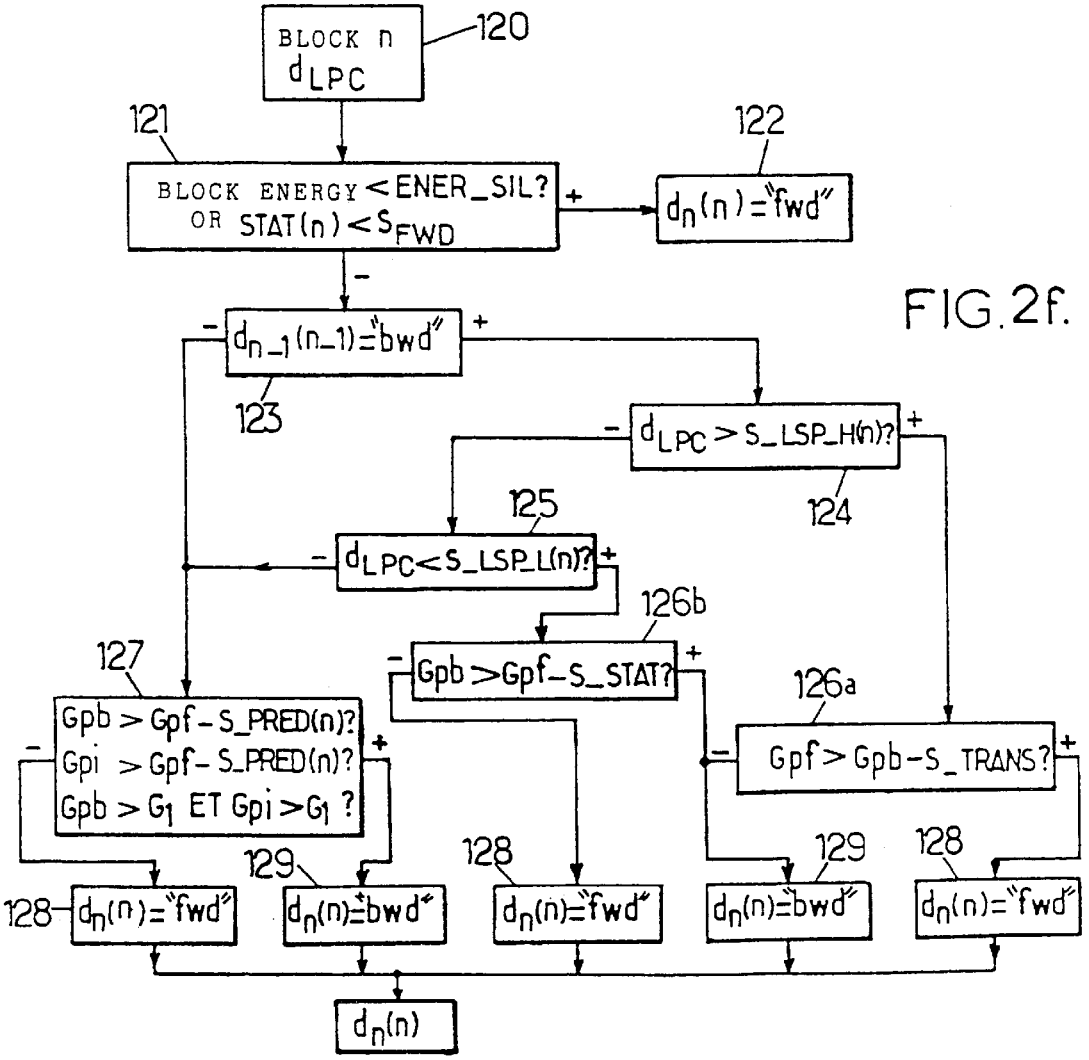
FIG. 2*f* shows as an explanatory example a flow chart of the stages making it possible to employ the decision function and the "forward" or "backward" LPC analysis choice value.
Figure 2B:
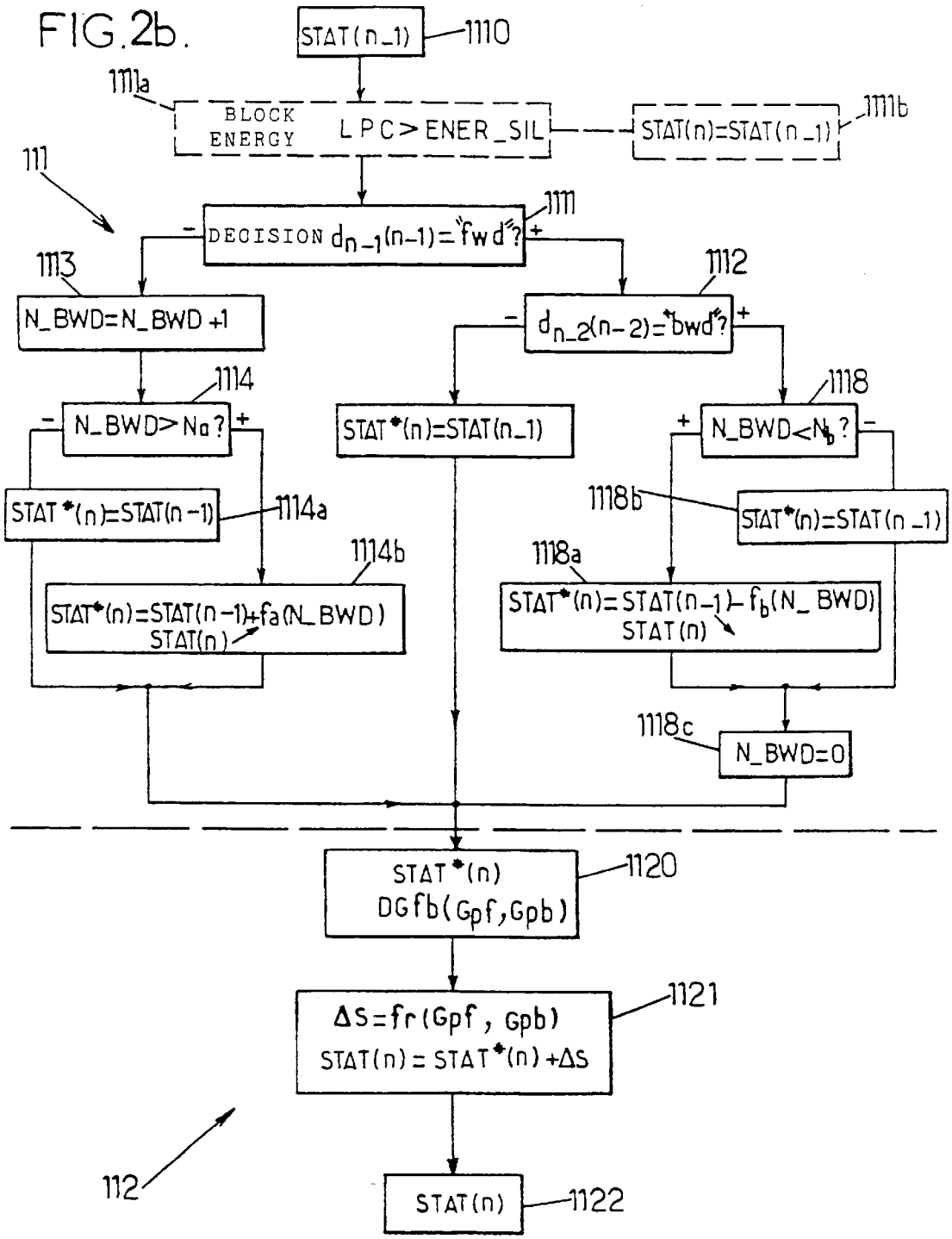
FIG. 2*b* shows a particularly advantageous method of carrying out the essential stages of the calculation of the stationarity parameter, according to FIG. 2*a;*

A more detailed description of the calculation stage 111 of the intermediate stationarity parameter STAT*(n) and of stage 112 which consists of tuning this parameter value is now given in connection with FIG. 2*b*.

According to the aforementioned figure, stage 111, starting with an initialization stage 1110 in which the value of the stationarity parameter STAT(n−1) and the analysis choice value $d_{n-1}(n-1)$ relating to the LPC block $B_{n-1}$ prior to the current block $B_n$ is available, consists to carry out in stage 1111 a stage which consists of discriminating the "forward" or "backward" LPC analysis mode of the block $B_{n-1}$ preceding the current block $B_n$. This discrimination stage 1111, as shown in FIG. 2*b*, may consist of a test stage for the analysis choice value $d_{n-1}(n-1)$ in relation to the symbolic value "fwd" or the logical value zero, corresponding to the complementary value of the true logical value.

On a negative response to the aforementioned test 1111, that is, for any block $B_{n-1}$ preceding the current block $B_n$, analyzed in "backward" LPC analysis mode, the stage which calculates the intermediate stationarity parameter value consists, in stage 1113, of determining the number of previous frames consecutively analyzed in "backward" LPC analysis mode, written N_BWD; then, in stage 1114, it consists of comparing the superiority of the number of previous frames to an initial arbitrary value, written Na, representing a number of successive frames analyzed in "backward" LPC mode.

On a positive response to the superiority comparison of test 1114, the calculation stage consists of attributing in stage 1114*b*, to the intermediate stationarity parameter value STAT*(n), the value of the stationarity parameter of the block preceding the current block, STAT(n−1), increased by a determined value which depends on the first arbitrary value representing a number of successive analyzed frames, that is, the number of previous frames N_BWD, analyzed consecutively in "backward" LPC analysis mode. In stage 1114*b*, the determined value which depends on the first arbitrary value is written $f_n$(N_BWD). During the aforementioned stage, it can be seen that the intermediate stationarity parameter value STAT*(n) for the current LPC bloc $B_n$ is thus increased in relation to the value corresponding to the same stationarity parameter for the preceding block $B_{n-1}$.

On a negative response to the superiority comparison in the comparison test 1114, the value of the stationarity parameter STAT(n−1) of the block preceding the current block $B_n$, is attributed, in stage 1114*a*, to the intermediate stationarity parameter value STAT*(n).

However for every preceding bloc $B_{n-1}$ analyzed in "forward" LPC analysis mode, that is, on a positive response to test 1111, the stage for calculating the intermediate stationarity parameter, 111, as shown in FIG. 2*b*, consists of determining in stage 1112, on the test criterion, the occurrence of a transition from "backward" LPC analysis mode to "forward" LPC analysis mode between the block before the block before the current bloc $B_{n-1}$, of row n−2, that is, the existence of an LPC analysis choice value $d_{n-2}(n-2)$= symbolic value "bwd", whose logical value is zero, as mentioned above. The positive response to test 1112 indicates the existence of such a transition from the "backward" analysis mode by the LPC block $B_{n-1}$ preceding the block preceding the current block $B_{n-1}$, whereas a negative response to the aforementioned test 1112 indicates the absence of such a transition.

On a positive response to the aforementioned occurrence test 1112, the calculation stage 111 then consists of comparing using an inferiority comparison criterion, the number of previous aforementioned N_BWD frames with a second arbitrary value $N_b$ which represents a number of frames successively analyzed in "backward" LPC mode preceding the bloc $B_{n-1}$ preceding the current bloc.

On a positive response to the comparison performed in test 1118, this test is followed by stage 1118*a*, which consists of attributing to the intermediate stationarity parameter value STAT*(n) the stationarity parameter value of the block preceding the current block, STAT(n−1), reduced by a determined value which depends on the second arbitrary value $N_b$; this determined value is written $f_2$(N_BWD). It can be seen that in the attribution stage 1118*a*, the intermediate stationarity parameter value is thus reduced as a result.

However on a negative response to the inferiority comparison carried out in test 1118, stage 111 consists then in allocating, in a stage 1118*b*, to the value of the intermediate stationary parameter STAT*(n) the value of the stationarity parameter of the block preceding the current block, i.e. STAT(n−1).

In FIG. 2*b* it will be noticed that the allocation stages 1118*a* and 118*b* are then followed by a stage of replacing with zero the number of successive blocks processed in the "backward" LPC analysis mode, this stage of making to zero carrying the reference 1118*c* and enabling the updating the whole of the calculation process of the value of the intermediate stationarity parameter.

On a negative response to the comparison test 1112, no "forward" LPC transition analysis occurring, the value of the stationarity parameter STAT(n−1) of the preceding block $B_{n-1}$ is attributed to the value of the intermediate stationarity parameter STAT*(n) in a stage 1119.

At the end of stage 111, the value of the intermediate stationarity parameter STAT*(n) is set for the current block $B_n$.

As far as the stage 112 consisting in tuning the value of the aforementioned intermediate stationarity parameter is concerned, it is noted, by reference to FIG. 2*b*, that it consists to advantage, of a stage 1120, in distinguishing the prediction gains of the "backward" LPC filtering and the "forward" LC filtering, these gain values being noted Gpb and Gpf respectively. It is understood that the aforementioned discrimination consists simply in memorizing and reading the gain values calculated for the respectively aforementioned "forward" and "backward" filtering. As well as the aforementioned gain values, the stage 1120 may consist of calculating the comparative value of the prediction gains, noted DGfb, as the difference or the ratio between the aforementioned "forward" and "backward" prediction gains.

As has been shown furthermore in FIG. 2*b*, the stage 112 of FIG. 2*a* includes behind the aforementioned stage 1120 a stage 1121 consisting of modifying the value of the intermediate stationarity parameter STAT*(n) with a refining value ΔS, this refining value according to a particularly noteworthy characteristic of the method which is the object of the present invention being a function of the comparative value of the "forward" and "backward" LPC filtering prediction gains.

As a general rule, it is indicated that the function representative of the refining value ΔS is noted:

$$\Delta S = f_r(Gpf, Gpb)$$

where Gpf and Gpb designate as previously the "forward" and "backward" LPC filtering prediction gains respectively.

As a general rule, it is indicated that the function $f_r$(GPf, Gpb) enabling the setting up of the refining value ΔS is a function respectively increasing and decreasing with this comparative value, according to the direction in which this comparative value is considered. When the comparative value designates the value of the "backward" LPC filtering gain comparative to the "forward" LPC filtering gain, this choice may be arbitrarily retained without any damage in the general nature of the method, the object of the invention, to the aforementioned comparative value DGfb, the function fr is then increasing. It is decreasing in the opposite case.

In other terms, the modification, by increasing or decreasing, the value of the intermediate stationarity parameter of the refining value ΔS is proportional to this comparative value of the gains. As a general rule, this modification is written STAT(n)=STAT*(n)+kΔS. In practice k is taken as equal to 1. In more specific terms, it is shown that the refining value ΔS increases in algebraic value when the gap between the "forward" and "backward" LPC filtering prediction gains increases, the function $f_r$(GPf, Gpb) being then an increasing function, whereas this refining value ΔS decreases in algebraic value when this same aforementioned gap decreases, the aforementioned gap being defined between the prediction gain of the LPC "backward" filtering and the prediction gain of the LPC "forward" filtering. In fact, this function is increasing or decreasing according to the definition of this gap.

Consequently, at the end of stage 1121 as shown in FIG. 2*b*, the value of the intermediate stationarity parameter STAT*(n) can then, for k=1, be corrected by the algebraic value of the aforementioned refining value ΔS in order to calculate the value of the stationarity parameter STAT(n).

Following stage 1121, the value of the stationarity parameter STAT(n) is set in stage 1122.

Figure 2C:
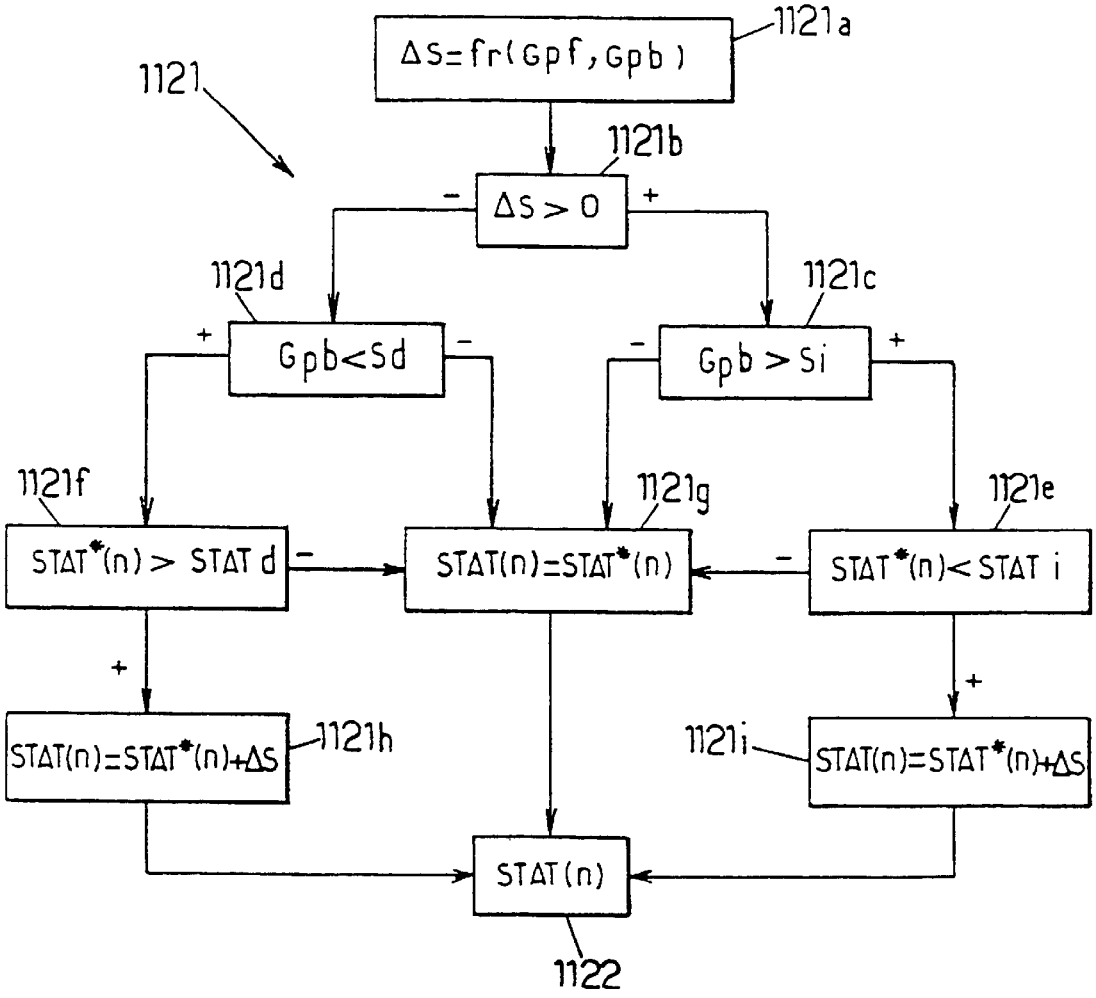
FIG. 2*c* shows a detail of the execution of FIG. 2*b* and, more particularly, a detail of the process of tuning the value of the intermediate stationarity parameter in order to obtain the stationarity parameter.

A more detailed description of the stage 1121 of FIG. 2*b* will be now given in connection with FIG. 2*c* in a preferential version in which several test criteria are applied as much as to the refining value as to the values of the LPC "forward" and "backward" prediction gain in view of optimizing the calculation process of the stationarity parameter.

As is shown in the aforementioned FIG. 2*c*, the stage 1121 can consist of a first stage 1121*a* enabling the calculation of the refining value ΔS from the previously quoted function $f_r$(Gpf, Gpb). Different examples of useable functions will be given later in the description.

In the first place, the refining value ΔS is subject to a superiority comparison test with the value 0, in a stage 1121*b*, this comparison test enabling in fact to determine the increase of this refining value ΔS.

On a positive response to the aforementioned test 1121*b*, the refining value ΔS being positive and corresponding to an increase in the comparative value of the "forward" and "backward" LPC filtering prediction gains, the stage of increasing the value of the intermediate stationarity parameter from the refining value ΔS is moreover subjected to a superiority condition of the gain value of "backward" LPC filtering, in comparison with a first positive value determined in a superiority comparison stage of the value of the "backward" LPC filtering gain value Gpb in comparison with this first determined positive value, called $S_i$.

On a negative response to the aforementioned test 1121*c*, the value of the intermediate stationarity parameter STAT*(n) is attributed to the value of the stationarity parameter STAT(n) in a stage 1121*g*.

On a positive response to the aforementioned test 1121*c*, the increase of the value of the intermediate stationarity parameter of the refining value ΔS is furthermore subjected to an inferiority condition of the value of the intermediate stationarity parameter STAT*(n) in comparison with a second determined positive value $STAT_i$ representing of course a stationarity value. This inferiority test condition is carried out in the stage 1121*e*.

On a negative response to the aforementioned test 1121*e*, the value of the intermediate stationarity parameter STAT*(n) in the aforementioned stage 1121*g* is attributed to the value of the intermediate stationarity parameter STAT(n).

On a positive response to the inferiority test condition 1121*e* the value of the intermediate stationarity parameter STAT*(n) increased by the positive value ΔS of the refining value in the stage 1121*i* is attributed to the value of the intermediate stationarity parameter STAT(n).

In contrast, on a negative response to the aforementioned test 1121*b*, the refining value ΔS being negative, the reduction stage of the intermediate stationarity parameter with the refining value ΔS, this value being negative, is furthermore subject to an inferiority test condition of the "backward" LPC filtering gain value Gpb in comparison with a determined third positive value called $S_d$ in a comparison stage 1121*d*. This third determined positive value is of course representative of an LPC filtering gain value.

On a negative response to the aforementioned test 1121*d* the value of the intermediate stationarity parameter STAT*(n) is attributed to the value of the stationarity parameter STAT(n) in the stage 1121*g*.

In contrast, on a positive response to the aforementioned test 1121*d*, the reduction stage of the value of the intermediate stationarity parameter with the refining value ΔS is furthermore subject to a superiority condition of the value of the intermediate stationarity parameter STAT*(n) in comparison with a fourth determined positive value, called STATd in a comparison test called 1121*f*. Of course, the fourth determined positive value is representative of a chosen stationarity parameter value.

On a negative response to the aforementioned test 1121*f*, the value of the intermediate stationarity parameter STAT*(n) is attributed to the stationarity parameter STAT(n) in the stage 1121*g*.

On a positive response to the aforementioned test 1121*f*, the value of the intermediate stationarity parameter STAT* (n) increased by the algebraic value of the refining value ΔS, negative, is attributed to the stationarity parameter STAT(n), the value of the intermediate stationarity parameter being thus reduced in order to set up the value of the stationarity parameter STAT(n) in the stage 1121*h*.

At the end of the stages 1121*g*, 1121*h* and 1121*i*, the stationarity parameter STAT(n) is thus set in the stage 1122 of FIG. 2*b*.

As regards the function $f_r$(Gpf, Gpb), it is shown that it may consist of a non linear function of the comparative value of the "forward" and "backward" LPC filtering gains in which the comparative value of the "forward" and "backward" LPC filtering prediction gains may themselves consist either in the ratio of, or in the difference of the "forward" and "backward" LPC filtering prediction gains. Other types of functions, such as linear functions, may be used.

Figure 2D:
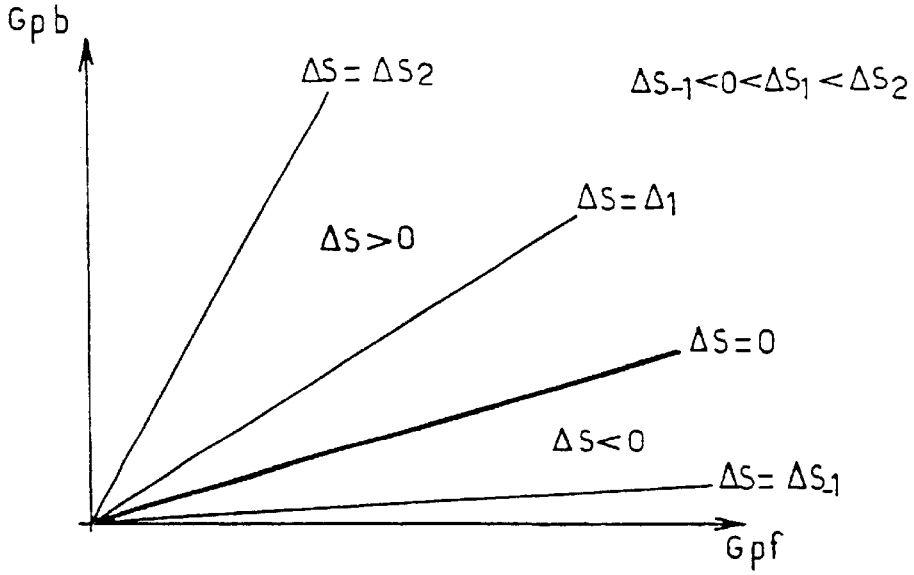
FIGS. 2*d* and 2*e* show, respectively, a first and second example of the application of a tuning function, allowing for the calculation of a tuning value for the intermediate stationarity function according to the comparative values of the "forward" and "backward" LPC filter gain.

A first example of the non linear function $f_r$(Gpf, Gpb) is shown in FIG. 2*d*.

In the version example of FIG. 2*d*, value pairs of the "backward" LPC filtering prediction gain Gpb in the ordinate and the "forward" LPC filtering gain Gpf enable allocating the positive refining values ΔS, ΔS>0 or negative ΔS<0 for a value of the ratio ρ=Gpb/Gpf corresponding to a respectively greater or lesser slope than that of the straight line ΔS=0.

Figure 2E:
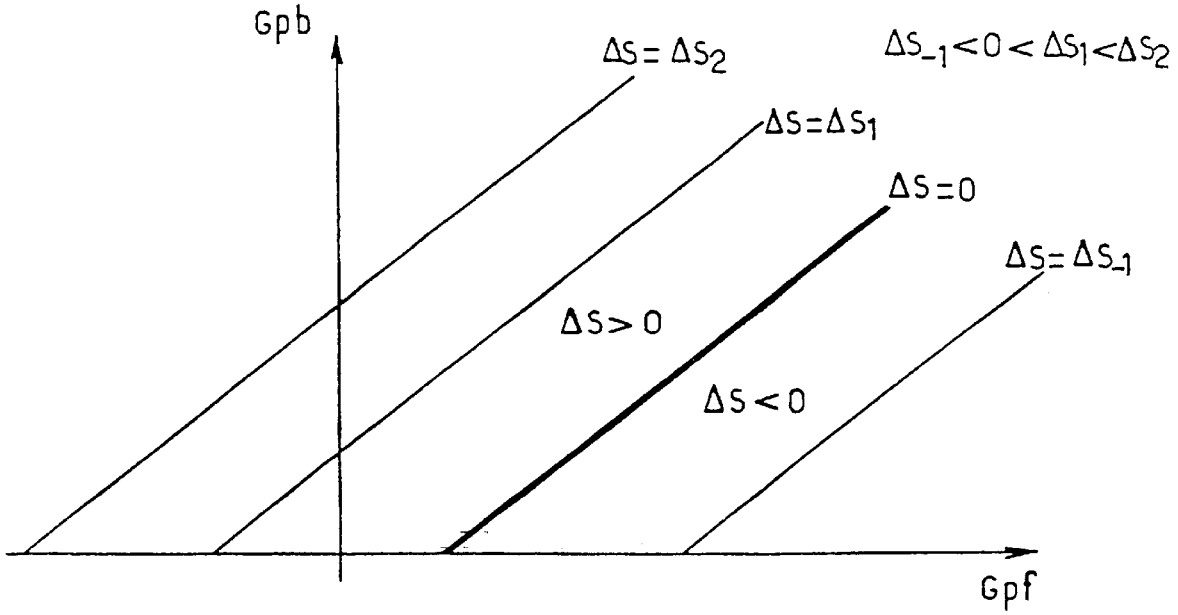

In FIG. 2*e*, has been shown the case where the relative value of the "forward" and "backward" filtering prediction gains no longer correspond to the ratio of the gains ρ but to the difference of the aforementioned gains. In this case, the relative value of the "forward" and "backward" LPC filtering prediction gains can also be a non linear function enabling allocating to the refining value ΔS for the values of this difference corresponding to the value pairs Gpb, Gpf corresponding to the straight lines for which the abscissa origin is respectively less or greater, in algebraic value, than the abscissa origin of the straight line ΔS=0. In the case of FIG. 2*e*, the straight lines delimiting the zones as a function of the sign of the refining value ΔS are parallel to each other.

According to another particular aspect of the procedure which is the object of the invention, it is recommended furthermore that it is accepted not to adapt the stationarity index of the current block $B_n$ during the silence frames, when for example the audio frequency signal is constituted by a speech signal comprising silences. In such a case, the stage 1111 of the stage 111 shown in FIG. 2*b* can be preceded by a stage 1111*a* consisting, for each successive current block, in determining the mean energy of the audio frequency digital signal and comparing in this same stage, on inferiority comparison criterion, this mean energy with a determined threshold value representative of a silence frame. In FIG. 2*b*, this threshold value is called ENER_SIL. On a positive response to the aforementioned test, the value of the stationarity parameter of the preceding block STAT (n−1) in the allocation stage 1111*b* shown in FIG. 2*b* is attributed to the value of the stationarity parameter of the current block STAT(n). The stages 1111*a* and 1111*b* are, in the aforementioned figure, shown as a dotted line, because it is reserved for example to the coding of a speech signal.

A more detailed description of the implementation decision function $D_n$ enabling the decision values $d_n$(n) to be obtained will be now given in connection with FIG. 2*f*. This description is given in a preferential version in which this decision function, being able to be compared with that which is described in the previously mentioned article by the description, published by S. PROUST, C. LAMBLIN and D. MASSALOUX, is however temporally adapted, according to the object of the present invention in order to obtain the successive choice analysis $d_n$(n) values.

Starting with a stage 120, for the current block $B_n$, in the first place a distance, called $d_{LPC}$, between the LPC filter of the current block and that of the preceding block $B_{n-1}$ is calculated. This distance calculation is carried out for example by using the LSP frequency parameters as previously mentioned in the description relating to the procedure described in the aforementioned article.

It is noted:

- the values of the thresholds S_PRED(n) and S_TRANS, S_STAT and $G_1$ being reached in the criterion justified on the prediction gains of the "backward" and "forward" LPC filters;
- the threshold values S_LSP_L and S_LSP_H being reached in the criterion justified on the distances between LSP frequency vectors representing two "forward" LPC filters comparative to two consecutive blocks $B_{n-1}$ and $B_n$;
- the prediction gain Gpf of the "forward" LPC filter;
- the prediction gain Gpb of the "backward" filter; and
- the prediction gain Gpi of the "forward" filter interpolated according to the method explained in the published article, previously mentioned in the description.

The criterion for establishing the decision function, in relation to FIG. 2*f*, is established in the manner below:

- if the consecutive LPC filters are very stationary, i.e. for $d_{LPC}$<S_LSP_L, then, no switching of the "backward" LPC filtering with the "forward" LPC filtering is carried out if it is in the "backward" LPC filtering mode, on condition that the prediction gain of the "backward" LPC filter is greater than the prediction gain of the "forward" LPC filter reduced by a S_STAT value. It is mentioned that the S_STAT value is chosen so as to favor the choice of a "backward" LPC filter in the presence of a large stationarity of the spectrum measured by means of the distance $d_{LPC}$;
- if the consecutive LPC filters have a significant transition, i.e. for $d_{LPC}$>S_LSP_H and if Gpf>Gpb−S_TRANS, then the chosen filtering mode is the "forward" LPC filtering, i.e. $d_n$(n)=0, symbolic value "fwd", otherwise, $d_n$(n) is almost equal to 1, symbolic value "bwd". It is mentioned that the value of S_TRANS is chosen so as to strongly favor the choice of the "forward" LPC filter in the presence of a spectrum transition measured by means of the distance $d_{LPC}$;
- otherwise, in all other cases, if Gpb>Gpf-S_PRED and Gpi>Gpf-S_PRED, then, the LCP filter retained is the interpolated "backward" LPC filter, on condition that the gain of this latter and that of the pure "backward" LPC filter exceeds the threshold value $G_i$ previously mentioned. If the condition on the values of the aforementioned prediction gain is not fulfilled, then, the "forward" LPC filtering is chosen.

In order to increase the number of transmitted "forward" LPC filters and thus to increase the strength of the coding system to the transmission errors, the "forward" LPC filtering mode may be chosen with advantage as soon as the energy signal to be coded $E_n$, i.e. the energy of the corresponding block $B_n$, becomes less than the value of the energy of a silence frame ENER_SIL, this value of energy corresponding to the minimum audible level.

The set of the conditions enabling the establishment of the decision function $D_n$ and the obtaining of the corresponding chosen analysis values $d_n$(n), is illustrated in FIG. 2*f* with temporal adaptation of the decision function $D_n$.

The value of the stationarity parameter STAT(n) can for example be located on a scale of 0, corresponding to the non-stationary $STAT_n$ value, to 100, corresponding to the very stationary $STAT_{(n)}$ value.

According to the value of the stationarity parameter STAT(n), the decision function $D_n$ is modified by adaptation of the value of the thresholds.

The more the stationarity of the signal increases, the more the "backward" LPC filtering mode is favored: the thresholds S_PRED, S_LSP and S_LSP_H are increased.

As a non-limited example, the modification functions for each current LPC block $B_n$ of the aforementioned threshold values have been shown:

S_PRED(n)=$f_{s_PRED}$(STAT(n)) with the function $f_{s_PRED}$ increasing with the value of STAT(N);

S_LSP_L(n)=$f_{S_LPC_L}$(STAT(n)) with the function $f_{S_LPC_L}$ increasing;

S_LSP_L(n)=$f_{s_LPC_R}$(STAT(n)) with the function $f_{s_LPC_R}$ increasing.

In the adaptation of the aforementioned threshold values, it has been shown that the increasing functions mentioned are for example functions for that which concerns the functions $f_{S_LPC_L}$ and $f_{S_LPC_H}$. The function $f_{S_PRED}$ is a refined function of the variable stationarity parameter, of the form:

$$S_PRED(n)=\alpha.STAT(n)+\beta$$

where $\alpha$ and $\beta$ are two real values between 0 and 1 and where the value of S_PRED(n) is limited in the interval [$S_PRED_m$, $S_PRED_M$], $S_PRED_m$ and $S_PRED_M$ representing two experimentally determined values.

In order to limit yet again the risk of switching filters, it is then possible to choose, when the stationarity parameter STAT(n) is less than a given threshold value $S_{FWD}$, to require the "forward" LPC filtering mode.

On the other hand, the S_TRANS, S_STAT and $G_1$ threshold values retain a fixed value, these values being able for example to be equal to −1 dB, 5 dB and 0 dB respectively.

The establishment of the decision function $D_n$ and the obtaining of the analysis choice values $d_n(n)$ are illustrated in the following way in FIG. 2*f*: following the aforementioned stage 120, carrying out a test stage 121 relative to the energy of the current LPC block $B_n$, by an inferiority comparison with the silence energy value ENER_SIL or with the value of the stationarity parameter STAT(n), compared by an inferiority comparison with the value $S_{FWD}$ quoted previously in the description. On a positive response to the aforementioned test 121, the choice analysis value $d_n(n)$ is taken as equal to 0, i.e. a symbolic value "fwd" in the stage 122.

On a negative response to the aforementioned test 121, a new test is carried out relative to the choice analysis value $d_{n-1}(n-1)$ with the logical value 1, i.e. with the symbolic value "bwd".

On a positive response to the aforementioned test 123, a new test is carried out on the aforementioned LPC filtering distance $d_{LPC}$, in a stage 124, in comparison with the threshold value S_LSP_H(n) by superiority comparison with this threshold value.

On a positive response to the aforementioned test 124, a new test 126*a* is carried out, consisting of comparing the "forward LPC filtering prediction gain, Gpf, with the "backward" LPC filtering prediction gain, Gpb, reduced by the threshold value S_TRANS.

On a positive response to the aforementioned test 126*a*, the logical value 0, symbolic value "fwd", is attributed to the choice analysis value $d_n(n)$, and on a negative response to the aforementioned test 126*a*, the same value of choice analysis is attributed the value 1, symbolic value "bwd". The corresponding stages are called 128 and 129.

On a negative response to the previously mentioned test 124, a new test 125 is carried out. The test 125 consists in carrying out a comparison of the distance of the LPC filtering, $d_{LPC}$, by inferiority comparison with the threshold value S_LSP_L(n).

On a positive response to the test 125, a new test 126*b* is carried out by superiority comparison of the "backward" LPC filtering prediction gain with the "forward" LPC filtering prediction gain reduced by the previously mentioned value S_STAT.

On a positive response to the test 126*b*, the logical value 1 is attributed to the value of the choice analysis $d_n(n)$ in the stage 129, i.e. the symbolic value "bwd".

On a negative response to the test 126*b*, the logical value 0 is attributed to the value of the choice analysis $d_n(n)$, i.e. the symbolic value "fwd", stage 128.

In contrast, on a negative response to the test 125, a new test is carried out, in a stage 127, this test consisting of verifying the comparison conditions of the "backward" LPC filtering gain Gpb with the "forward" LPC filtering prediction gain reduced by the threshold value S_PRED(n), by superiority comparison of the intermediate LPC filtering prediction gain Gpi with the "forward" LPC filtering prediction gain value reduced by the aforementioned threshold value S_PRED(n) and by superiority comparison of the "backward" filtering prediction gain Gpb with the threshold value $G_1$, as well as comparison of the value of the intermediate filtering prediction gain Gpi with the threshold value $G_1$.

It is mentioned that the negative response to the test 123 previously mentioned in the description leads also to the carrying out of the aforementioned test 127.

On a positive response to the previously mentioned test 127, the logical value 1 is attributed to the value of the choice analysis $d_n(n)$, i.e. the symbolic value "bwd" in the stage 129, whereas with a negative response to the aforementioned test 127, the logical value 0 is on the contrary attributed to the value of the choice analysis $d_n(n)$, i.e. the symbolic value "fwd" in the stage 128.

Thus is set, by means of using the decision function $D_n$, the value of the choice analysis $d_n(n)$ obtained with the aforementioned logical values 1 or 0, these logical values being however connected to a priority or absence of priority value of returning to the "backward" or "forward" filtering mode as a function of the value of the stationarity parameter.

A more detailed description of a coding device of an audio frequency digital signal by double analysis on the criterion of respectively "forward" or "backward" LPC choice analysis in a transmitted coded signal, according to the object of the present invention, will now be given in connection with FIG. 3.

In a practical manner, it is mentioned that the digital signal to be coded is subdivided into frames constituted by successive blocks of samples, each block comprising a given number N of samples for example.

Figure 3:
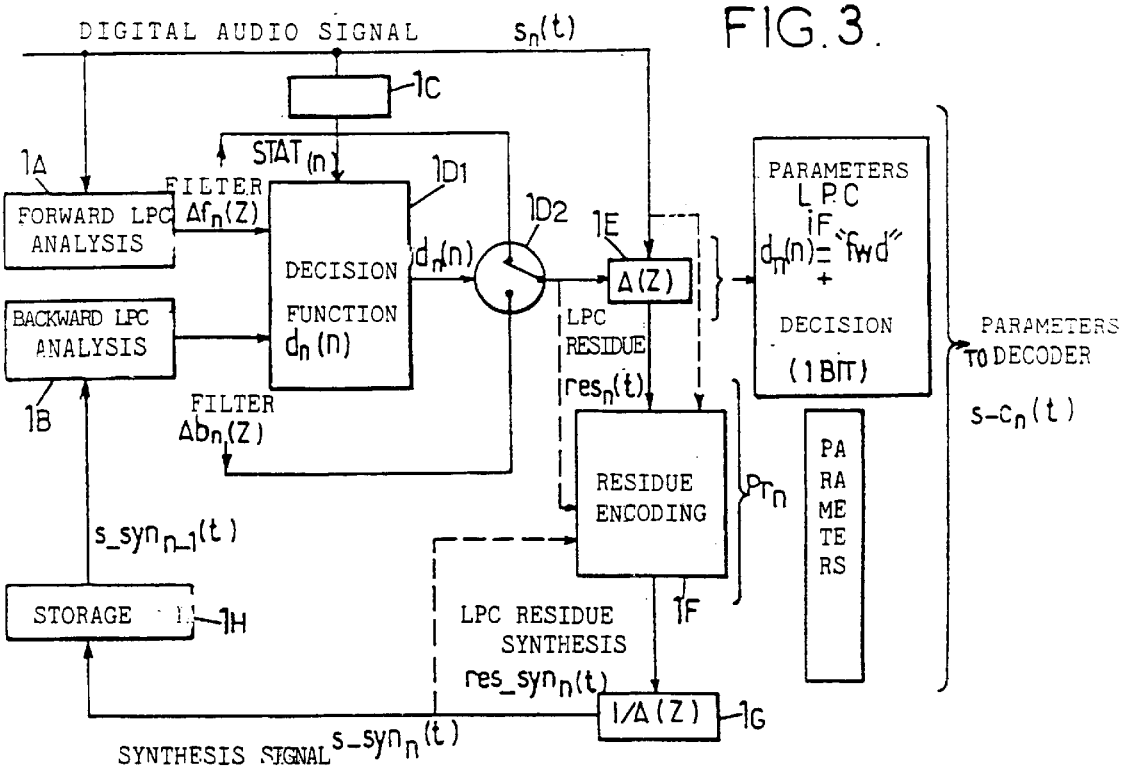
FIG. 3 shows, in the form of functional blocks, the general diagram of an encoder which makes it possible to code an audio-frequency signal according to the object of the present invention.

In FIG. 3, constitution mode of the audio frequency digital signal to be coded in successive blocks of samples $B_n$ has not been shown for this operating mode is well known in the state of the technical art and can be carried out form a simple memory buffer, for example addressed to periodically read the frame frequency and the block frequency.

As shown furthermore in the aforementioned FIG. 3, the coding device which is the object of this invention includes a "forward" LPC analysis filter, carrying the reference 1A, and a "backward" analysis filter, carrying the reference 1B, in order to enable the delivery of a transmitted coded signal consisting of LPC filtering parameters accompanied by an analysis decision indication, as well as Pr parameters, relative to the harmonic analysis and to the excitation signal CELP.

Generally, it is shown that the analysis decision indication corresponds of the value of choice analysis $d_n(n)$ as mentioned previously in the description. In so far as the LPC filtering parameters, it is mentioned that these correspond to specific parameters, according to the mode used of the coding method which is the object of the present invention as will be described later in the description.

In FIG. 3, also has been shown, in the coding device according to the invention, the existence of an adaptive filter operating as a function of the value of the stationarity parameter, this adaptive filter carrying the reference 1E. This adaptive filter 1E receives, it is understood of course, the original digital signal called $s_{n(t)}$, i.e. the current block $B_n$. The filter 1E uses the filtering LPC parameter in order to calculate the residual signal which in turn is coded by the module 1F. These LPC parameters, as well as the filtering decision indication constitute a part of the coded signal which is transmitted to the decoder.

Furthermore, as shown in FIG. 3, the coding device which is the object of the present invention includes a coding means, carrying the reference 1F, of a non transmitted residue coding signal, the residue coding signal, designated by $res_{n(t)}$ is directly available at the output of the adaptive filter 1E, this signal being thus delivered to the input with the audio frequency digital signal at the coding module of the not transmitted residue coding signal, in order to generate a synthesis residue signal, $res_syn_{n(t)}$.

A reverse filtering module, carrying the reference 1G, receives the synthesis residue signal and enables the delivery of a synthesis signal referenced $s_syn_{n(t)}$.

A memorization module 1H receives the aforementioned synthesis signal $s_syn_{n(t)}$ in order to deliver the aforementioned synthesis signal for the previous block to the current block $B_n$, the synthesis signal thus obtained being designated by $s_syn_{n-1}(t)$. This synthesis signal is delivered to the "backward" LPC analysis filter carrying the reference 1B in the aforementioned FIG. 3.

The coding device, which is the object of the present invention, as shown in FIG. 3, enables carrying out a coding of the audio frequency digital signal on the aforementioned audio frequency digital signal from the "forward" LPC filter for the non-stationary zones and on the aforementioned synthesis signal $s_syn_{n-1}(t)$ from the "backward" LPC filter 1B for the stationary zones, as will be described below.

As will be observed in the aforementioned FIG. 3, the device which is the object of the invention comprises in this aim, for each current LPC block $B_n$, a calculation module 1C of the degree of stationarity of the audio frequency digital signal according to a stationarity parameter the value of which is between a maximum stationarity value and a minimum stationarity value. Of course, the stationarity parameter is the parameter STAT(n) previously described in the description according to the coding procedure which is the object of the present invention. The maximum and minimum stationarity values are also defined previously.

As has been shown furthermore in FIG. 3, the coding device which is the object of the invention includes a module, called 1D, for establishing from the aforementioned stationarity parameter STAT(n) a decision function and an LPC choice analysis value, the decision function being called $D_n$ as previously mentioned in the description, and the LPC choice analysis value being of course corresponding to the value of the LPC choice analysis called $d_n(n)$ previously mentioned in the description. It will be recalled that the value of the choice analysis $d_n(n)$ can take the values 0 or 1, logical values, which correspond to the choice analysis symbolic value "fwd" and "bwd" for the "forward" and backward" LPC analysis respectively.

It is understood in particular that concerning the establishment of the decision function $D_n$, which corresponds for example to a software implementation, such as previously described in connection with FIG. 2*f*. Furthermore, the coding device according to the invention such as shown in FIG. 3 includes an LPC filtering analysis discrimination module, called $\mathbf{1}D_2$, this module receiving the value of the choice analysis $d_n(n)$ and enabling delivering, for the current LPC block $B_n$, the value of the LPC "backward" and "forward" filtering parameters respectively as a function of the aforementioned value of choice analysis. It is clearly understood that the "backward" LPC filtering analysis as well as the "forward" LPC filtering analysis parameters are of course available in digital form at the filters carrying the reference 1B and 1A respectively in FIG. 3. These parameters are designated respectively $Af_n(z)$ for the "forward" LPC filtering analysis parameters with regard to the "forward" LPC analysis filter, carrying the reference 1A, and by $Ab_n(z)$ for the "backward" LPC analysis parameters with regard to the "backward" LPC analysis filter carrying the reference 1B. These parameters are delivered to the module $\mathbf{1}D_1$ and the module $\mathbf{1}D_2$ respectively.

As regards the creation of the equipment of the discrimination module $\mathbf{1}D_1$, it is shown that it may for example, in a non-limitative version, consist of two distinct memory zones enabling the memorization of the filtering parameters $Af_n(z)$ and $Ab_n(z)$ respectively, the value of choice analysis $d_n(n)$ as a function of its current logical value, 0 or 1, enabling the addressing for reading the values of the memorized filtering parameters by the module $\mathbf{1}D_2$ for example and the transmission of these filtering parameters by this latter.

Finally, as shown in FIG. 3, it has been shown that the coding device according to the object of the present invention, for the operation of the adaptive filter according to the stationarity value carrying the reference 1E , can be carried out by a filtering element the transfer function of which, called A(z), is established from the filtering parameter values delivered by the discrimination module $\mathbf{1}D_2$ previously mentioned.

It is understood as well that the adaptive filtering module 1E can be achieved by a filter with adjustable coefficients, with the value of the coefficients of this latter delivered by the discrimination module $\mathbf{1}D_2$ previously mentioned. The filtering carried out by the module 1E is thus of the adaptive type operating as a function of the degree of stationarity of the audio frequency digital signal to be coded. The module 1E thus delivers, from the original audio frequency digital signal $sn_{(t)}$, the LPC filtering residue signal designated by $res_n(t)$ to the coding module of the residue 1F, which enables then the delivery of the LPC synthesis residue signal designated by $res_syn_n(t)$.

Finally, the module 1 G is a filtering module the transfer function of which is the reverse of the transfer function of the module 1E obtained form the memorized parameters of this latter. It receives the LPC synthesis residue signal $res_syn_n(t)$ delivered by the coding module of the coding residue delivered by the module 1F. It is thus understood that the coding of the audio frequency digital signal $s_n(t)$ is carried out in the module 1E through the LPC "forward" and "backward" analysis respectively which is carried out by the LPC "forward" and "backward" analysis filters 1A, 1B, the coded signal $s_c_n(t)$ consisting in the transmission of the "forward" LPC filtering parameters when the value of the choice analysis $d_n(n)$ has the symbolic value "fwd" as well as the indication of the choice analysis, i.e. of the value of the preceding quoted value of the choice analysis. This mode of operation enables carrying out the coding of the audio frequency digital signal and favoring holding it in one of the respectively "forward" and "backward" LPC filtering modes, as a function of the degree of stationarity of the digital signal, and limiting furthermore the number of switchings from one to the other of the considered filtering modes.

A decoding device of a coded audio frequency digital signal by double analysis on the criterion of respectively "forward" and "backward" LPC analysis, to a coded signal transmitted according to the coding method which is the object of the present invention, and by means of using a coding device such as shown in FIG. 3 for example, will now be described in connection with FIG. 4.

In a general manner, it is shown that the transmitted coded signal $s_c_n(t)$ consists for each LPC analysis block of the value of the aforementioned choice analysis and, in the case where the value of choice analysis corresponds for the considered LPC analysis block to a "forward" LPC analysis, of the "forward" LPC filtering parameters as well as the coding parameters of the LPC filtering residue, $Pr_n$ parameters, i.e. of the signal $res_n(t)$ in a synthesis residue signal $res_syn_n(t)$ by the residue coding module 1F.

Figure 4:
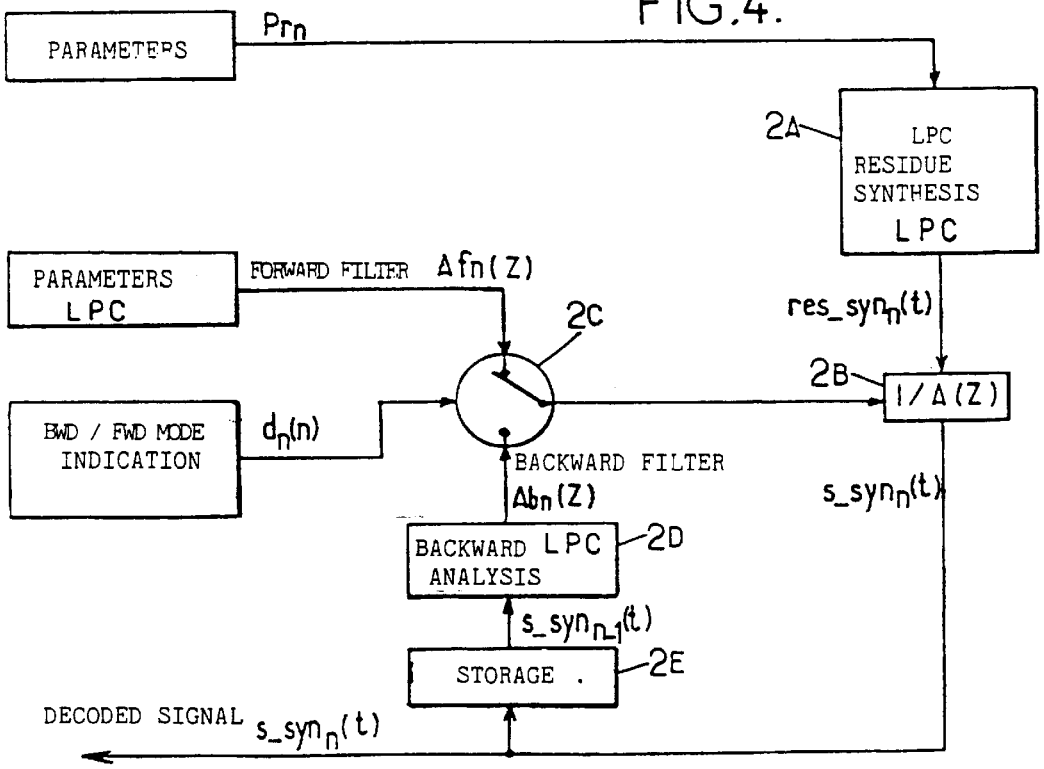
FIG. 4 shows, in the form of functional blocks, the general diagram of a decoder which makes it possible to decode an audio-frequency signal which has been coded by using an encoder as shown in FIG. 3.

As shown in FIG. 4, it is shown that the decoding device comprises at least a synthesis module, referenced 2A, of the filtering residue signal receiving the coding parameters of the LPC residue delivered by the module 1F. The module 2A decodes the coding parameters supplied by the module 1F and delivers consequently a synthesis residue signal, which is referenced in FIG. 4 $res_syn_n(t)$.

The decoding device as shown in FIG. 4 comprises also a module, carrying the reference 2B, of reverse adaptive filtering as a function of the degree of stationarity, receiving the previously quoted synthesis residue signal, delivered by the module 2A, and enabling the generation of a synthesis signal $s_syn_n(t)$ representative of the audio frequency digital signal, this signal constituting in fact the decoded signal.

It is of course understood that the reverse filtering module 2B uses the filtering parameters received by the decoder due to the fact of the transmission, are the "forward" LPC analysis parameters when these are transmitted and that the analysis decision corresponds to a "forward" LPC analysis or, in contrast, the "backward" filtering analysis parameters as will be described below.

With this aim, the decoding device which is the object of the present invention comprises of course a "backward" LPC filtering module, carrying the reference 2D, receiving the synthesis signal, i.e. the signal referenced $s_syn_n(t)$ for the LPC block preceding the current LPC block, this synthesis signal being thus referenced s $s_syn_{n-1}(t)$ in FIG. 4. With this aim, it is understood that the synthesis signal relative to the current block $B_n$ and referenced $s_syn_n(t)$ may then be delivered to the "backward" filtering module 2D by means of a memorization module, carrying the reference 2E, enabling in fact, by an adapted addressing for reading, to shift the reading of the synthesis signal to that corresponding to the block preceding, the current block $B_n$.

Finally, and to ensure the aforementioned operating mode, the decoding device which is the object of the present invention, as shown in FIG. 4, further includes a discriminator module carrying the reference 2C, enabling the carrying out of a "forward" and "backward" LPC discrimination analysis respectively. The module 2C receives, on the one hand, to control the discrimination, the value of choice analysis received, i.e. the value $d_n(n)$, and, on the other hand, the "forward" LPC filtering parameters, i.e. the parameters $Af_n(z)$ transmitted, as well as the "backward" LPC filtering parameters $Ab_n(z)$ obtained by means of the module 2D. The module 2C thus enables delivering, as a function of the choice analysis value, i.e. of the value $d_n(n)$, either the "forward" filtering parameters $Af_n(z)$, or the "backward" filtering parameters $Ab_n(z)$ to the reverse adaptive filtering module 2B as a function of the degree of stationarity.

As regards the material embodiment of the modules 2C and 2B, it is mentioned that these may simply consist of modules approximately identical to the modules $\mathbf{1}D_2$ and 1E or, more particularly, 1G of FIG. 3.

As regards the effective embodiment of a coding device according to the object of the present invention, enabling using the procedure such as described previously in the description, two specific versions have been carried out.

Telephonic Band CELP Type Encoder, According to High Output Extension of the UIT-T Standard at 8 kb/s:

The actual encoder consisted of a telephonic band encoder from 300 to 3400 Hz, with an output of 12 kb/s of CELP type. The frames were constituted over a duration of 10 ms for an excitation supplied by algebraic codepages according to the technique called ACELP previously mentioned in the description.

The "forward" LPC analysis was an analysis of order 10 and the "backward" LPC analysis an analysis of order 30 every 80 samples.

A separation for the coding of the residue into two sub-blocks of 40 samples has been carried out. Each block $B_n$ included 80 samples.

Adaptation of the Stationarity Parameter STAT(n)

The aforementioned stationarity parameter varies between two extreme values 0 and 100, the aforementioned values $STAT_m$ and $STAT_M$.

The adaptation functions previously described in the description, and in particular the functions $f_a(N_BWD)$ and $f_b(N_BWD)$ were such that:

$$f_a(N_BWD) = \begin{cases} 1.56 \text{ if } N_BWD > 20 \\ 7.81 \text{ if } N_BWD = 20 \\ 0 \text{ otherwise} \end{cases}$$

$$f_b(N_BWD) = \begin{cases} 0.78 \cdot (20 - N_BWD) \text{ if } N_BWD \leq 20 \\ 0 \text{ otherwise} \end{cases}$$

In these relations, x=DGfb.

As regards the function $f_r$ enabling the refining value $\Delta S$ previously mentioned in the description to be established, this is a step function of the variable x, with x=Gpb−Gpf and $\Delta S = f_r(x)$ and having the value:

$$f_r(x) = \begin{cases} 10 \text{ if } x \geq 4 \\ 7.5 \text{ if } x \in [3; 4[ \\ 5 \text{ if } x \in [2; 3[ \\ 2.5 \text{ if } x \in [1; 2[ \\ 1.25 \text{ if } x \in [0; 1[ \\ 0.625 \text{ if } x \in [-1; 0[ \\ 0 \text{ if } x \in [-2; -1[ \\ -2.5 \text{ if } x \in [-3; -2[ \\ -5 \text{ if } x \in [-4; -3[ \\ -10 \text{ if } x \in [-5; -4[ \\ -20 \text{ if } x < -5 \end{cases}$$

The tuning of STAT(n) is furthermore subject to the following conditions previously mentioned in relation with FIG. 2*c:*

If ΔS>0:

If STAT*(n)<$STAT_i$ STAT(n)=STAT*(n)+ΔS

Otherwise STAT(n)=STAT*(n)

Otherwise:

STAT(n)=STAT*(n)

with $STAT_i$=40.6

The other test conditions referenced 1121*d*, 1121*c* and 1121*f* in FIG. 2*c* have not been used in the version.

Adaptation of the Decision Thresholds

As regards the decision thresholds:

S_PRED is adapted in the following manner:

S_PRED(n)=0.03.STAT(n)+1.0

S_PRED ∈[$S_PRED_m$, $S_PRED_M$], $S_PRED_m$=1.03 and $S_PRED_M$=4;

The threshold S_LSP_L is adapted using the following step function:

$$S_LPS_L(n) = f_{S_LPC_L}(STAT(n)) = \begin{cases} 0.015 \text{ if } STAT(n) = 100 \\ 0 \quad \text{otherwise} \end{cases}$$

The threshold value S_STAT used in case of stationarity of the LPC filters measured using the threshold S_LSP_L has been fixed at 4.0 dB.

The threshold S_LSP_H has not been used in this version.

The value of the threshold $G_1$ has been fixed at 0 db.

As regards the energy value characterizing a silence frame ENER_SIL, this value has been fixed at 40 dB measured over the 80 samples s(i) of the current block $B_n$:

$$ENER_SIL = 10 \cdot \text{Log}\left(\sum_{i=0}^{i(80} (s(i))^2\right)$$

As regards the value of the previously mentioned $S_{FWD}$ threshold intended to limit still further the risk of switching by imposing the "forward" LPC filter mode when the STAT(n) value is lower than this threshold, this $S_{FWD}$ value has been set at 40.6.

A second Version of a CELP Broadened Band Encoder with Two Sub-bands 16/24/32 kb/s was Carried Out in the Following Conditions:

a broadened band encoder of 0 to 7000 Hz in two sub-bands. A main band was encoded with the CELP technique, frame with 120 samples, excitation created by algebraic codepages, and transmission of certain energy and spectrum characteristics of a host band of between 6000 Hz and 7000 Hz.

"forward" LPC analysis with 14 coefficients and "backward" LPC analysis with 50 coefficients every 120 samples. In "forward" LPC analysis mode, separation into two 60 sample LPC sub-blocks, the filter used for the first sub-block being interpolated from the current filter and the previous filter.

Calculation of the Stationarity Parameter STAT(n)

In this version, the aforementioned stationarity parameter varies between the two extreme values 0 and 120, the aforementioned $STAT_m$ and $STAT_M$ values.

As regards the adaptation of the stationarity parameter value STAT(n), the values of the $f_a$(N_BWD) and $f_b$(N_BWD) functions are such that:

$$f_a(N_BWD) = \begin{cases} 4 \text{ if } N_BWD > 10 \\ 20 \text{ if } N_BWD = 10 \\ 0 \quad \text{otherwise} \end{cases}$$

$$f_b(N_BWD) = \begin{cases} 10 - N_BWD \text{ if } N_BWD \leq 10 \\ 0 \quad \text{otherwise.} \end{cases}$$

As regards the fr function allowing the refining value ΔS previously mentioned in the description to be set, this is a step function of the variable x, with x=Gpb/Gpf and ΔS=$f_r$(x) and having a value of:

$$f_r(x) = \begin{cases} 9 \text{ if } x \geq 1.2 \\ 6 \text{ if } x \in [1.1; 1.2[ \\ 3 \text{ if } x \in [1.05; 1.1[ \\ 1.5 \text{ if } x \in [1.0; 1.05[ \\ 0.75 \text{ if } x \in [0.95; 1.0[ \\ 0 \text{ if } x \in [0.9; 0.95[ \\ -1.5 \text{ if } x \in [0.85; 0.9[ \\ -3 \text{ if } x \in [0.8; 0.85[ \\ -6 \text{ if } x \in [0.75; 0.8[ \\ -12 \text{ if } x < 0.75 \end{cases}$$

The tuning of STAT(n) is moreover subject to the following previously mentioned conditions in relation with FIG. 2*c*: If ΔS>0:

```
If Gpb > Si
    If STAT*(n) < STAti        STAT(n) = STAT*(n) + ΔS
    Otherwise                  STAT(n) = STAT*(n)
  Otherwise STAT(n) = STAT*(n)
Otherwise:
    If STAT*(n) < STAti        STAT(n) = STAT*(n) + ΔS
    Otherwise                  STAT(n) = STAT*(n)
with STAti = 80, Si = 0 dB.
```

The other test conditions referenced 1121*h* and 1121*d* in FIG. 2*c* have not been used in this version.

Adaptation of Decision Thresholds

As regards the decision thresholds:

S_PRED is adapted in the following way:

S_PRED(n)=0.03 STAT(n)−0.5 limited in the interval

[$S_PRED_m$, S_PREDM ]

with $S_PRED_m$=0.5 and $S_PRED_M$=2.5.

The S_LSP_L threshold is adapted with the help of the following step function:

$$S_LSP_L(n) = f_{S_LSP_L}(STAT(n)) = \begin{cases} 0.02 \text{ if } STAT(n) > 100 \\ 0.01 \quad \text{otherwise} \end{cases}$$

The S_LSP_H threshold is adapted with the help of the following step function:

$$S_LSP_H(n) = f_{S_LSP_L}(STAT(n)) = \begin{cases} 0.08 \text{ if } STAT(n) > 100 \\ 0.01 \quad \text{otherwise} \end{cases}$$

The value of the S_TRANS threshold used in the case of transition of the LPC filters measured with the help of the S_LSP_H threshold has been set at 0 dB.

The value of the S_STAT threshold used in the case of stationarity of the LPC filters measured with the help of the S_LSP_L threshold has been set at 2.5 dB.

The value of the G threshold has been set at 0 dB.

As regards the energy value characterizing a frame of silence ENER_SIL, this value has been set at 50 dB measured over the 120 samples s(i) of the current block $B_n$:

$$ENER_SIL = \text{Log}\left(\sum_{i=0}^{i<120} (s(i))^2\right)$$

As regards the value of the previously mentioned $S_{FWD}$ threshold intended to limit still further the risk of switching by imposing the "forward" LPC filter mode when the STAT(n) value is lower than this threshold, this $S_{FWD}$ value has been set at 60.

What is claimed is:

1. A method for encoding a digital audio signal by dual analysis according to a choice criterion of LPC "forward" and "backward" analysis respectively into a transmitted encoded signal consisting of LPC filtering parameters accompanied by analysis decision information, and into a residue encoding signal, not transmitted, said digital audio signal being subdivided into frames, a succession of blocks of a specified number of samples, the encoding of said digital audio signal being carried out on this signal through a "forward" LPC filtering for non-stationary zones respectively on a synthesis signal, obtained from said residue encoding signal, through a "backward" LPC filtering for stationary zones, wherein said choice criterion consists, on each current block of said succession of current blocks constituting a current frame:

in defining the degree of stationarity of the digital audio signal according to a stationarity parameter, the value of which lies between a maximum stationarity value and a minimum stationarity value;

in establishing, from said stationarity parameter, an analysis choice value, from a decision function;

in applying said analysis choice value to the "forward" LPC filtering so as to carry out the encoding of said digital audio signal by "forward" LPC filtering for non-stationary zones on said digital audio signal, and by "backward" LPC filtering respectively for stationary zones on said synthesis signal, which makes it possible to favor the maintenance of the digital audio signal in one of the "forward" and "backward" filtering modes respectively in relation to the degree of stationarity and to limit the amount of switching from one to the other and vice versa of the filtering modes.

2. The method according to claim 1, wherein said decision function is an adaptive function, actualized for each current block from the stationarity parameter, said actualization of said adaptive function making it possible to favor the maintenance of the digital audio signal filtering in one of the "forward" and "backward" filtering modes respectively as a function of the degree of stationarity of said digital audio signal and thus to limit the amount of switching from one to the other and vice versa of the filtering modes.

3. The method according to claim 1, wherein said analysis choice value established from said decision function corresponds to a "forward" LPC filtering mode priority value and a "backward" LPC filtering mode priority value respectively.

4. The method according to claim 1, wherein the stage consisting in specifying the degree of stationarity of each current block of said digital audio signal consists, starting from an arbitrary starting value of said stationarity parameter:

in calculating for said current block an intermediate stationarity parameter value, as a function of a specified number of analysis choice values, obtained for different successive blocks prior to said current block of said succession of blocks, and of the stationarity parameter value of the block preceding the said current block;

in tuning said intermediate stationarity parameter value as a function of the value of prediction gains of the "forward" and "backward" LPC filtering of the frame preceding said current frame.

5. The method according to claim 4, wherein the stage consisting, for each current block, in calculating an intermediate stationarity parameter value consists:

in discriminating between the "forward" LPC or "backward" LPC analysis mode of the block preceding said current block; and for any previous block analyzed by "backward" LPC analysis mode:

in specifying the number of previous frames consecutively analyzed in "backward" LPC analysis mode, in comparing, according to a superiority comparison criterion, said number of previous frames with a first arbitrary value representative of a number of successive frames analyzed in "backward" LPC mode, and on positive response to this superiority comparison, attributing to said intermediate stationarity parameter value the stationarity parameter value of the block preceding said current block, augmented by a specified value function of said first arbitrary value, and on negative response to this superiority comparison, attributing to said intermediate stationarity parameter value the stationarity parameter value of the block preceding said current block; and for any previous block analyzed in "forward" LPC analysis mode, in specifying according to a test criterion the occurrence of a transition from "backward" LPC analysis mode to "forward" LPC analysis mode between the block prior to said preceding block and said preceding block, and on positive response to said test of occurrence, in comparing, according to an inferiority comparison criterion, said number of previous frames with a second arbitrary value representative of a number of successive frames analyzed in "backward" LPC mode preceding said preceding block, and on positive response to said inferiority comparison, attributing to said intermediate stationarity parameter value the stationarity parameter value of said block preceding the current block, reduced by a specified value which is a function of said second arbitrary value, and on negative response to said inferiority comparison, attributing to said intermediate stationarity parameter value the stationarity parameter value of said preceding block.

6. The method according to claim 4, wherein the stage consisting for each current block in tuning said intermediate stationarity parameter value consists:

in distinguishing between prediction gains of the "forward" LPC filtering and "backward" LPC filtering;

in modifying the intermediate stationarity parameter value of a refining value function of the relative value of prediction gains of "forward" and "backward" LPC filtering, the modification, increase or reduction, of the intermediate stationarity parameter value being proportional to said refining value.

7. The method according to claim 6, wherein the stage of increase proportional to said refining value of the intermediate stationarity parameter value is moreover subject to a condition of superiority of said value of "backward" LPC filtering gain relative to a first specified positive value and to a condition of inferiority of the value of said intermediate stationarity parameter value relative to a second specified positive value.

8. The method according to claim 6, wherein the stage of reduction proportional to said refining value of the intermediate stationarity parameter value is moreover subject to a condition of inferiority of said value of "backward" LPC filtering gain relative to a third specified positive value and to a condition of superiority of the value of said intermediate stationarity parameter value relative to a fourth specified positive value.

9. The method according to claim 6, wherein said relative value of the prediction gains of "forward" and "backward" LPC filtering consists in the ratio or the difference between prediction gains of "forward" and "backward" LPC filtering.

10. The method according to claim 1, wherein said method consists in addition, for each successive current block:

in establishing the average energy of said digital audio signal, in comparing, according to an inferiority comparison criterion, said average energy with a specified threshold value representative of a silence frame, and on positive response to said inferiority comparison, in attributing to said stationarity parameter of the current block the stationarity parameter value of the preceding block.

11. The method according to claim 2, wherein, for a degree of stationarity represented by a stationarity parameter between a minimum value and a maximum value, said minimum value representing the degree of stationarity of a substantially non-stationary digital signal and said maximum value representing the degree of stationarity of a substantially stationary signal, said adaptive function constituting the decision function is an increasing function of the priority value of the "backward" LPC filtering mode according to the increasing degree of stationarity of said digital signal.

12. An encoding device for a digital audio signal by dual analysis according to a choice criterion of "forward" and "backward" LPC analysis respectively into a transmitted encoded signal, said digital signal being subdivided into frames constituted by successive blocks comprising a specified number of samples, said encoding device comprising a "forward" LPC analysis filter and a "backward" LPC filter enabling delivery of a transmitted encoded signal consisting of LPC filtering parameters accompanied by an analysis decision indication and a means of encoding an encoding residue signal, not transmitted, enabling generation of a synthesis residue signal, the encoding of said digital audio signal being carried out on this digital audio signal from the "forward" LPC filter for non-stationary zones and on this synthesis signal, from the "backward" LPC filter respectively for stationary zones, wherein said encoding device comprises in addition, for each current LPC block;

calculation means of the degree of stationarity of said digital audio signal, according to a stationarity parameter the value of which is between a minimum stationarity value and a maximum stationarity value;

setting means, from a stationarity parameter, of a decision function enabling an LPC analysis choice value to be set;

discrimination means of LPC analysis receiving said analysis choice value and enabling delivery, for said LPC current block, of the value of the "backward" and "forward" LPC filtering parameters respectively as a function of said analysis choice value;

adaptive filtering means as a function of the degree of stationarity receiving said digital audio signal and the value of the "forward" and "backward" LPC filtering parameters respectively as a function of said analysis choice value and delivering the encoding residue signal to said encoding means of the encoding residue signal, which makes it possible to encode said digital audio signal and to favor the maintenance of said digital audio signal in one of the "forward" and "backward" filtering modes respectively in relation to the degree of stationarity of said digital signal and to limit the amount of switching from one to the other and vice versa of the filtering modes.

13. The encoding device according to claim 12, wherein said transmitted encoded signal consists, for each LPC analysis block, of:

said analysis value, and in the case where the analysis choice value corresponds for LPC analysis block considered, to a "forward" LPC analysis;

said "forward" PC filtering parameters.

14. A decoding device of a digital audio signal encoded by dual analysis according to a choice criterion of "forward" and "backward" LPC analysis respectively, into a transmitted encoded signal consisting of LPC filtering parameters accompanied by an analysis decision indication, wherein that said transmitted encoded signal, consisting for each LPC analysis block of said analysis choice value and corresponding for the LPC analysis block considered to "forward" LPC analysis in "forward" LPC filtering parameters, said decoding device comprises at least:

synthesis means for the filtering residue signal receiving said encoding parameters of the LPC residue and delivering a synthesis residue signal, reverse filtering adaptive means as a function of the degree of stationarity, receiving the synthesis residue signal and enabling generation of a synthesis signal representative of the digital audio signal and constituting the decoded signal, "backward" LPC analysis means receiving said synthesis signal and enabling generation of "backward" LPC filtering parameters, discriminating means between "forward" LPC analysis and "backward" LPC analysis respectively receiving, on the one hand, for discrimination control said analysis choice value and, on the other hand, the "forward" LPC filtering parameters and the "backward" LPC filtering parameters and enabling delivery as a function of said analysis choice value, of either "forward" LPC filtering parameters, or "backward" LPC filtering parameters to said reverse filtering adaptive means as a function of the degree of stationarity.

* * * * *